US010761446B2

(12) United States Patent
Kusunoki

(10) Patent No.: US 10,761,446 B2
(45) Date of Patent: Sep. 1, 2020

(54) IMAGE FORMING APPARATUS AND COMPUTER-READABLE RECORDING MEDIUM STORING PROGRAM

(71) Applicant: Konica Minolta, Inc., Tokyo (JP)

(72) Inventor: Takahiro Kusunoki, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/407,512

(22) Filed: May 9, 2019

(65) Prior Publication Data

US 2019/0346785 A1 Nov. 14, 2019

(30) Foreign Application Priority Data

May 10, 2018 (JP) ..... 2018-091697

(51) Int. Cl.
*G03G 15/01* (2006.01)
*G03G 15/08* (2006.01)

(52) U.S. Cl.
CPC ..... *G03G 15/0173* (2013.01); *G03G 15/0126* (2013.01); *G03G 15/0812* (2013.01)

(58) Field of Classification Search
CPC ..... G03G 15/0126; G03G 15/0173; G03G 15/0812; G03G 15/5025; G03G 15/5062; G03G 15/5066
See application file for complete search history.

(56) References Cited

U.S. PATENT DOCUMENTS 2,584,695 A * 2/1952 Good ..... H04N 1/29 358/501
8,652,592 B2 * 2/2014 Hoshino ..... G09F 3/02 283/72
2009/0110443 A1 * 4/2009 Yamada ..... G03G 15/0812 399/284
2009/0110445 A1 * 4/2009 Yamada ..... G03G 15/0818 399/284
2013/0155163 A1 * 6/2013 Kudo ..... G03G 15/0266 347/112
2016/0041486 A1 * 2/2016 Hara ..... G03G 9/0819 430/109.1

FOREIGN PATENT DOCUMENTS

JP 2006270391 A 10/2006
JP 2016178388 A * 10/2016
JP 2016178388 A 10/2016

* cited by examiner

*Primary Examiner* — Francis C Gray
(74) *Attorney, Agent, or Firm* — Cantor Colburn LLP

(57) ABSTRACT

An image forming apparatus includes an image forming unit that has multiple developing units, arranged in series for basic colors in a rotational driving direction of a transfer body, for developing toner images of the basic colors based on input image data and forms the overlapped toner images on a surface of the transfer body in a state in which the toner images are aligned; a transferring unit that transfers the toner images onto a sheet; and a controller that calculates a difference between color information of an image obtained by reading the toner images and color information of the input image data, calculates a color change direction of the toner images with respect to a color of the input image data based on the difference, and refers to a table and determines a shape of a surface of the sheet based on information of the color change direction.

12 Claims, 32 Drawing Sheets

COLOR CHANGES CAUSED BY RECESSED AND PROTRUDING PORTIONS OF SHEET

FIG. 6

T1

| <COLOR CHANGE DIRECTION PATTERN> | | <PORTION DETERMINED TO BE RECESSED PORTION> |
|---|---|---|
| (1) | COLOR CHANGE TOWARD PRINTING DOWNSTREAM SIDE OCCURS AND COLOR CHANGE DOES NOT OCCUR | PORTION WHERE COLOR CHANGE TOWARD PRINTING DOWNSTREAM SIDE OCCURS |
| (2) | COLOR CHANGE TOWARD PRINTING UPSTREAM SIDE OCCURS AND COLOR CHANGE DOES NOT OCCUR | PORTION WHERE COLOR CHANGE DOES NOT OCCUR |
| (3) | ONLY COLOR CHANGES TOWARD PRINTING DOWNSTREAM SIDE OCCUR AND AMOUNTS OF CHANGES ARE DIFFERENT | PORTION WHERE AMOUNT OF COLOR CHANGE TOWARD PRINTING DOWNSTREAM SIDE IS LARGER |
| (4) | ONLY COLOR CHANGES TOWARD PRINTING DOWNSTREAM SIDE OCCUR AND AMOUNTS OF CHANGES ARE SAME | PORTION CANNOT BE DETERMINED BASED ON COLOR CHANGE DIRECTION AND IS ESTIMATED BASED ON PERIPHERAL PIXEL INFORMATION |

FIG. 8A

[MEASUREMENT POINT P1:
THIRD MAIN SCANNING COLUMN AND SECOND AUXILIARY SCANNING ROW]
→ DETECT COLOR CHANGE TOWARD PRINTING DOWNSTREAM SIDE

| | DETECTED DATA (COLOR INFORMATION) | | |
|---|---|---|---|
| | a* | b* | Hue |
| (MEASURED VALUE) | 65.9 | 38.2 | 28.3 |
| (THEORETICAL VALUE) | 66.7 | 44.9 | 34.0 |

FIG. 8B

[MEASUREMENT POINT P2:
THIRD MAIN SCANNING COLUMN AND THIRD AUXILIARY SCANNING ROW]
→ NO COLOR CHANGE

| | DETECTED DATA (COLOR INFORMATION) | | |
|---|---|---|---|
| | a* | b* | Hue |
| (MEASURED VALUE) | 66.7 | 44.9 | 34.0 |
| (THEORETICAL VALUE) | 66.7 | 44.9 | 34.0 |

FIG. 10

[RESULT OF DETERMINING SHAPE OF SHEET]

| <COLOR CHANGE DIRECTION PATTERN (1)> | <PORTION DETERMINED TO BE RECESSED PORTION> |
|---|---|
| COLOR CHANGE TOWARD PRINTING DOWNSTREAM SIDE OCCURS AND COLOR CHANGE DOES NOT OCCUR | PORTION WHERE COLOR CHANGE TOWARD PRINTING DOWNSTREAM SIDE OCCURS → MEASUREMENT POINT P1 |

FIG. 12A

[MEASUREMENT POINT P3:
SECOND MAIN SCANNING COLUMN AND SECOND AUXILIARY SCANNING ROW
→ NO COLOR CHANGE

| | DETECTED DATA (COLOR INFORMATION) | | |
|---|---|---|---|
| | a* | b* | Hue |
| (MEASURED VALUE) | −72.59 | 28.89 | 158.3 |
| (THEORETICAL VALUE) | −72.59 | 28.89 | 158.3 |

FIG. 12B

[MEASUREMENT POINT P4:
SECOND MAIN SCANNING COLUMN AND THIRD AUXILIARY SCANNING ROW
→ DETECT COLOR CHANGE TOWARD PRINTING UPSTREAM SIDE

| | DETECTED DATA (COLOR INFORMATION) | | |
|---|---|---|---|
| | a* | b* | Hue |
| (MEASURED VALUE) | −65.02 | 50.25 | 142.3 |
| (THEORETICAL VALUE) | −72.59 | 28.89 | 158.3 |

FIG. 14

[RESULT OF DETERMINING SHAPE OF SHEET]

| <COLOR CHANGE DIRECTION PATTERN (2)> | <PORTION DETERMINED TO BE RECESSED PORTION> |
|---|---|
| COLOR CHANGE TOWARD PRINTING UPSTREAM SIDE OCCURS AND COLOR CHANGE DOES NOT OCCUR | PORTION WHERE COLOR CHANGE DOES NOT OCCUR → MEASUREMENT POINT P3 |

FIG. 16A

[MEASUREMENT POINT P5:
SECOND MAIN SCANNING COLUMN AND SECOND AUXILIARY SCANNING ROW]
→ DETECT COLOR CHANGE TOWARD PRINTING DOWNSTREAM SIDE

| | DETECTED DATA (COLOR INFORMATION) | | |
|---|---|---|---|
| | a* | b* | Hue |
| (MEASURED VALUE) | -65.02 | 1.4 | 178.8 |
| (THEORETICAL VALUE) | -72.59 | 28.89 | 158.3 |

FIG. 16B

[MEASUREMENT POINT P6:
SECOND MAIN SCANNING COLUMN AND THIRD AUXILIARY SCANNING ROW]
→ DETECT COLOR CHANGE TOWARD PRINTING DOWNSTREAM SIDE

| | DETECTED DATA (COLOR INFORMATION) | | |
|---|---|---|---|
| | a* | b* | Hue |
| (MEASURED VALUE) | -68.34 | 15.0 | 168.3 |
| (THEORETICAL VALUE) | -72.59 | 28.89 | 158.3 |

FIG. 18

[RESULT OF DETERMINING SHAPE OF SHEET]

| <COLOR CHANGE DIRECTION PATTERN (3)> | <PORTION DETERMINED TO BE RECESSED PORTION> |
|---|---|
| ONLY COLOR CHANGES TOWARD PRINTING DOWNSTREAM SIDE OCCUR AND AMOUNTS OF CHANGES ARE DIFFERENT | PORTION WHERE AMOUNT OF COLOR CHANGE TOWARD PRINTING DOWNSTREAM SIDE IS LARGER → MEASUREMENT POINT P5 |

FIG. 20A

[MEASUREMENT POINT P7:
THIRD MAIN SCANNING COLUMN AND SECOND AUXILIARY SCANNING ROW]
→ DETECT COLOR CHANGE TOWARD PRINTING DOWNSTREAM SIDE

| | DETECTED DATA (COLOR INFORMATION) | | |
|---|---|---|---|
| | a* | b* | Hue |
| (MEASURED VALUE) | 65.9 | 38.2 | 30.1 |
| (THEORETICAL VALUE) | 66.7 | 44.9 | 34.0 |

FIG. 20B

[MEASUREMENT POINT P8:
FOURTH MAIN SCANNING COLUMN AND SECOND AUXILIARY SCANNING ROW]
→ DETECT COLOR CHANGE TOWARD PRINTING DOWNSTREAM SIDE

| | DETECTED DATA (COLOR INFORMATION) | | |
|---|---|---|---|
| | a* | b* | Hue |
| (MEASURED VALUE) | 65.9 | 38.2 | 30.1 |
| (THEORETICAL VALUE) | 66.7 | 44.9 | 34.0 |

FIG. 22

[RESULT OF DETERMINING SHAPE OF SHEET]

| <COLOR CHANGE DIRECTION PATTERN (4)> | <PORTION DETERMINED TO BE RECESSED PORTION> |
|---|---|
| ONLY COLOR CHANGES TOWARD PRINTING DOWNSTREAM SIDE OCCUR AND AMOUNTS OF CHANGES ARE SAME | PORTION CANNOT BE DETERMINED BASED ON COLOR CHANGE DIRECTION → PORTION IS ESTIMATED FROM PERIPHERAL PIXEL INFORMATION |

DETERMINATION OF P1
(FIRST TIME)
→ PROTRUDING PORTION
(WITH RELIABILITY OF 50%)

DETERMINATION OF P2
(FIRST TIME)
→ PROTRUDING PORTION
(WITH RELIABILITY OF 50%)

DETERMINATION OF P1
(SECOND TIME)
→ PROTRUDING PORTION
(WITH RELIABILITY OF 100%)

DETERMINATION OF P2
(SECOND TIME)
→ PROTRUDING PORTION
(WITH RELIABILITY OF 100%)

IMAGE FORMING APPARATUS AND COMPUTER-READABLE RECORDING MEDIUM STORING PROGRAM

CROSS-REFERENCE TO RELATED APPLICATIONS

The present application claims priority under 35 U.S.C. § 119 to Japanese Patent Application No. 2018-091697, filed on May 10, 2018, is incorporated herein by reference in its entirety.

BACKGROUND

Technological Field

The present invention relates to an image forming apparatus including a transfer unit for transferring a color toner image onto a sheet, and a computer-readable recording medium storing a program.

Description of the Related Art

Traditionally, in the field of image forming apparatuses, to suppress the consumption of toner and prevent a reduction in productivity, color correction to be performed using a user real image, which is not an image pattern (correction patch) specially prepared for correction, has been proposed.

Patent Literature 1 describes an image processing system including a means for analyzing color components included in image data, a means for identifying a color component to be corrected from the analyzed data, a means for identifying a region in which the identified color component exists, a means for performing measurement based on information of the identified region, and a means for performing color correction based on the obtained information.

In addition, Patent Literature 2 describes a technique for extracting portions that are included in a region and in which colors are uniform based on human sensitivity to a difference between colors when a person looks at a user image, allocating a large correction weight to an extracted portion having a large area, and performing color correction.

CITATION LIST

Patent Literature

[Patent Literature 1] Japanese Laid-open Patent Publication No. 2006-270391

[Patent Literature 2] Japanese Laid-open Patent Publication No. 2016-178388

SUMMARY

In the technique described in Patent Literature 2, however, since only portions in which colors are uniform are read, there is a problem that the numbers of colors and gradations able to be used for the color correction are reduced and the accuracy of the color correction is reduced. In addition, in the techniques described in Patent Literature 1 and 2, when a change in a color is detected from a user real image during the execution of a job using a sheet (for example, an embossed sheet) with a surface including recessed and protruding portions, whether the change in the color is caused by the surface with the recessed and protruding portions or caused by a variation in an engine is not clear, both of the causes cannot be distinguished, and the correction may be erroneously performed.

A shape of a sheet surface and a change in a color are described below with reference to FIG. 1 to FIG. 3. FIG. 1 shows an example of a schematic configuration of a general image forming apparatus. FIG. 2A to FIG. 2C show examples of the shape of the sheet surface and color changes. FIG. 3 is a graph showing the change in the color due to the sheet surface with recessed and protruding portions.

An image forming apparatus 200 shown in FIG. 1 is of an electrophotographic scheme. The image forming apparatus 200 includes an image forming unit 211, photoreceptor drums 215, an intermediate transfer belt 216, a transferring unit (fixing roller) 218, a fixer 230, and an inline sensor 261 (reader).

The image forming unit 211 includes image forming units 211Y, 211M, 211C, and 211K corresponding to basic colors, yellow (Y), magenta (M), cyan (C), and black (K). The image forming units 211Y, 211M, 211C, and 211K are arranged in this order from an upstream side to a downstream side in a rotational driving direction of the intermediate transfer belt 216. When the image forming units 211Y, 211M, 211C, and 211K do not need to be distinguished from each other, the image forming units 211Y, 211M, 211C, and 211K are collectively referred to as image forming units 211. The image forming units 211Y, 211M, 211C, and 211K respectively include developing units 214. The four photoreceptor drums 215 are installed corresponding to the image forming units 211Y, 211M, 211C, and 211K, respectively. Color toner images carried by the intermediate transfer belt 216 are transferred onto a sheet S conveyed on a conveyor path 220 at a nip portion between the transferring unit 218 and the intermediate transfer belt 216.

Yellow, magenta, cyan, and black toner images carried by the photoreceptor drums 215 for the respective colors are transferred onto the intermediate transfer belt 216 in a state in which the toner images are aligned. Thus, black toner is more easily transferred onto the sheet than cyan toner. Cyan toner is more easily transferred onto the sheet than magenta toner. Magenta toner is more easily transferred onto the sheet than yellow toner. As shown in FIG. 2A, when the sheet S, which does not have recessed and protruding portions like a normal sheet, is used, toner of the respective colors is properly transferred onto the sheet from the intermediate transfer belt 216. FIG. 2A shows an example in which cyan toner 201*c*, magenta toner 201*m*, and yellow toner 201*y* are transferred onto the sheet S (normal sheet).

As shown in FIG. 2B, however, when an embossed sheet with a surface including recessed and protruding portions is used as the sheet S, colors on the printing upstream side are hardly transferred onto the recessed portions of the embossed sheet, and colors change toward the printing downstream side (color change directions are only directions toward the printing downstream side). Alternatively, when a color changes due to not only the recessed and protruding portions of the surface of the sheet S but also the image forming unit 211 (printer engine), a color change direction may be a direction toward the printing upstream side. As shown in FIG. 3, when the surface of the sheet S includes the recessed and protruding portions, the phases of the monochromatic toner colors do not change, but it is apparent that the phases of multi-colors, each of which is formed by a combination of multiple toner colors, change toward the printing downstream side (in directions indicated by arrows).

As shown in FIG. 2C, a failure of the transfer of a portion of the yellow toner 201*y* and a failure of the transfer of a portion of the magenta toner 201*m* occur due to the recessed and protruding portions of the surface of the sheet S, the cyan toner 201*c* is deficient (as indicated by a broken line), and colors change toward the printing upstream side. As shown in FIG. 2B and FIG. 2C, when the recessed and protruding portions exist on the surface of the sheet, a color phase of an image transferred to the sheet may vary depending on the recessed and protruding portions of the surface of the sheet.

Under such circumstances, a method of removing an effect of the shape of the sheet surface and performing, with high accuracy, a process such as color correction using a result of detecting a real image has been required.

To achieve at least one of the abovementioned objects, according to an aspect of the present invention, an image forming apparatus reflecting one aspect of the present invention comprises a transfer body to be rotationally driven, an image forming unit that includes a plurality of developing units that are arranged in series for basic colors in a rotational driving direction of the transfer body and develop toner images of the basic colors based on input image data, and forms the overlapped color toner images on a surface of the transfer body in a state in which the toner images of the basic colors are aligned, and a transferring unit that transfers the color toner images formed on the transfer body onto a sheet. The image forming apparatus further comprises a controller that calculates a difference between color information of the color toner images on the sheet read by a reader and color information of the input image data, calculates a color change direction of the color toner images on the sheet with respect to a color of the input image data based on the difference between the color information, and refers to a table in which color change direction patterns are associated with portions determined to be recessed portions and determines a shape of a surface of the sheet based on information of the color change direction.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 6 is a diagram showing a table in which color change direction patterns are associated with portions determined to be recessed portions according to the first embodiment of the invention;

FIG. 8A is a diagram showing an example of color information of a measurement point P1 of detected data;

FIG. 8B is a diagram showing an example of color information of a measurement point P2 of detected data;

FIG. 10 is a diagram showing a result of determining the shape of the sheet;

FIG. 12A is a diagram showing an example of color information of a measurement point P3 of detected data;

FIG. 12B is a diagram showing an example of color information of a measurement point P4 of detected data;

FIG. 14 is a diagram showing a result of determining the shape of the sheet;

FIG. 16A is a diagram showing an example of color information of a measurement point P5 of detected data;

FIG. 16B is a diagram showing an example of color information of a measurement point P6 of detected data;

FIG. 18 is a diagram showing a result of determining the shape of the sheet;

FIG. 20A is a diagram showing an example of color information of a measurement point P7 of detected data;

FIG. 20B is a diagram showing an example of color information of a measurement point P8 of detected data;

FIG. 22 is a diagram showing a result of determining the shape of the sheet;

DETAILED DESCRIPTION OF EMBODIMENTS

Hereinafter, embodiments of the present invention will be described with reference to the drawings. However, the scope of the invention is not limited to the disclosed embodiments. Constituent elements having substantially the same function or configuration are indicated by the same reference symbol in the present specification and the drawings, and a duplicated description is omitted.

1. First Embodiment

In a first embodiment of the invention, a color (color phase) change direction of an output image is calculated from information of a difference between a result (read image) of detecting the output image on a sheet with a surface including recessed and protruding portions and input image data, and the recessed and protruding portions of the surface of the sheet are determined based on information of the color change direction. Thus, a change in a color can be corrected without using a detection patch for the sheet such as an embossed sheet or the like which has the surface including the recessed and protruding portions. It may be considered that the recessed and protruding portions of the sheet are relatively different in shape from each other. Hereinafter, a change in a color is referred to as "change" in some cases.

[Entire Configuration of Image Forming Apparatus]

Figure 1:
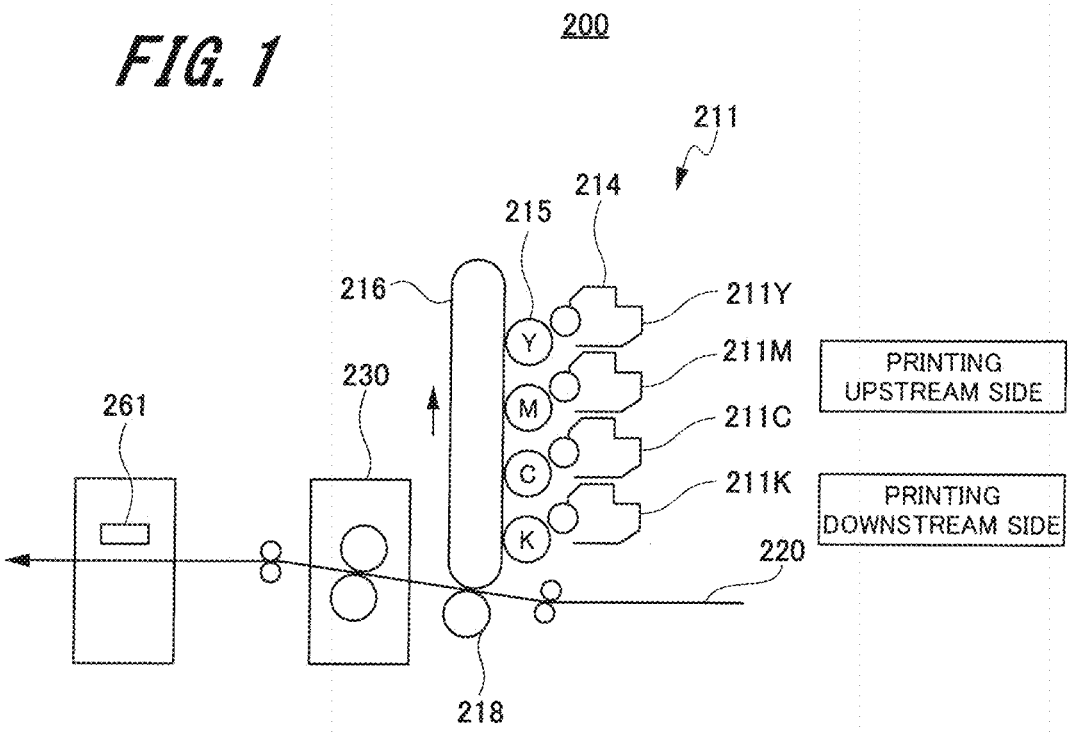
FIG. 1 is a diagram showing an example of a schematic configuration of a general image forming apparatus.
Figure 2A:
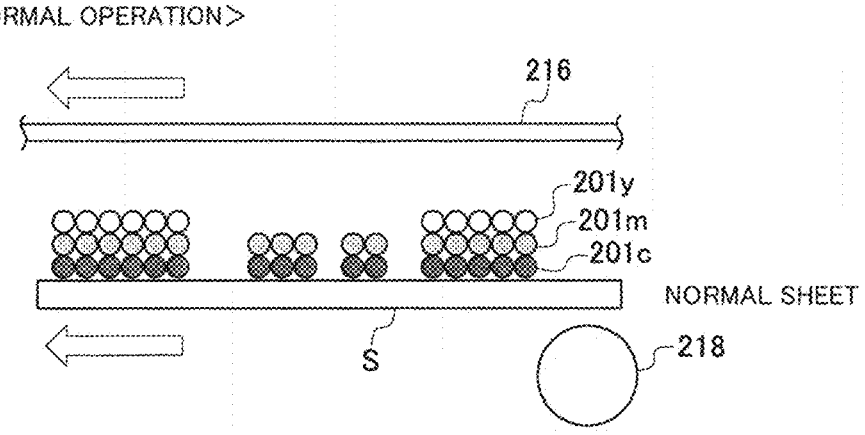
FIG. 2A is a diagram showing a first example of a shape of a surface of a sheet and no color change.
Figure 2B:
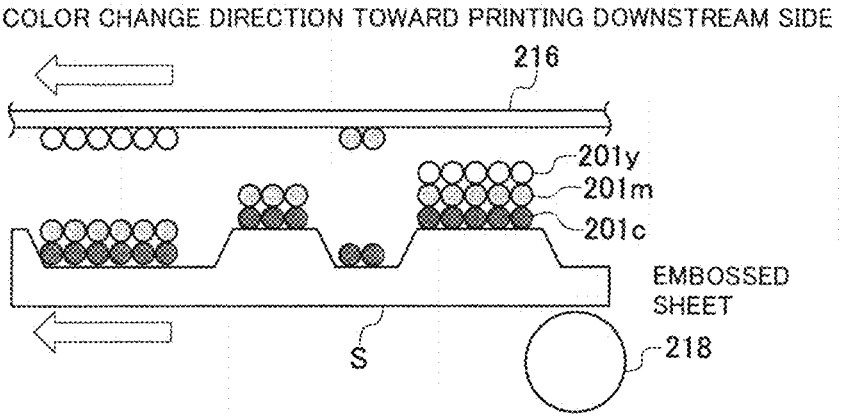
FIG. 2B is a diagram showing a second example of the shape of the surface of the sheet and color changes.
Figure 2C:
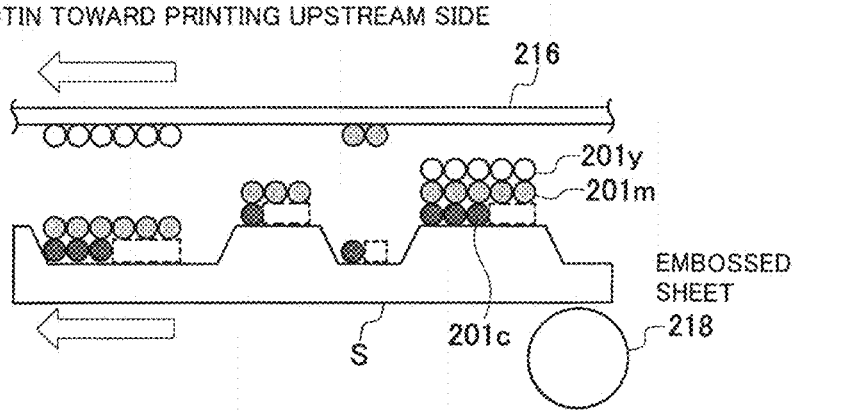
FIG. 2C is a diagram showing a third example of the shape of the surface of the sheet and color changes.
Figure 3:
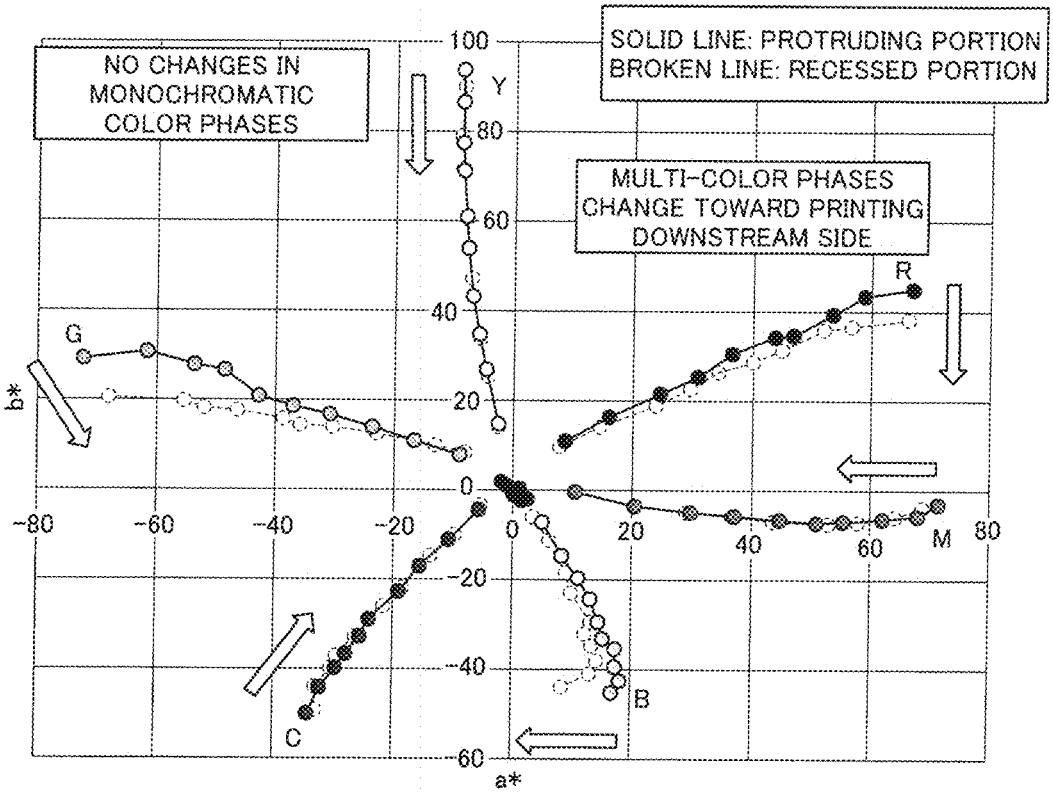
FIG. 3 is a graph showing color changes caused by recessed and protruding portions of the surface of the sheet.
Figure 4:
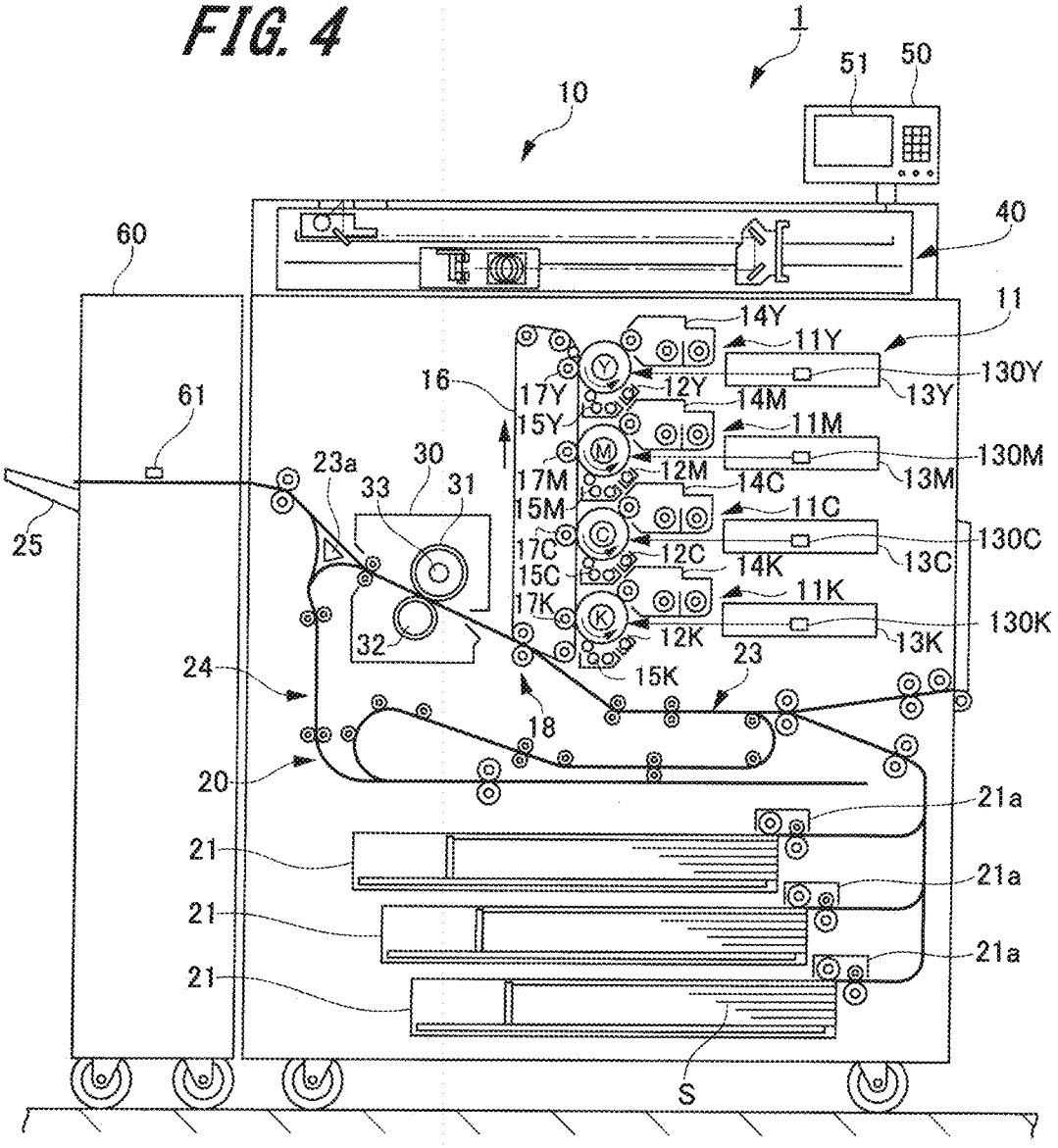
FIG. 4 is a schematic front view showing an example of an entire configuration of an image forming apparatus according to a first embodiment of the invention.

First, an entire configuration of an image formation system according to the first embodiment of the invention is described. FIG. 4 is a schematic front view showing an example of an entire configuration of an image forming apparatus according to the first embodiment.

The image formation system 1 shown in FIG. 4 includes an image forming apparatus body 10 and a post-processing device 60. The image forming apparatus body 10 is, for example, an image forming apparatus of an electrophotographic scheme such as a copy machine. The image forming apparatus is a so-called tandem-type color image forming apparatus that includes an endless intermediate transfer belt 16 (an example of a transfer body) and a plurality of photoreceptor drums (an example of the transfer body) corresponding to basic colors and arranged opposite to the intermediate transfer belt 16 in a vertical direction and forms a full-color image. The image forming apparatus body 10 can form a document image included in a received job on a sheet for each page and perform color correction in parallel with image formation.

The image forming apparatus body 10 includes an image forming unit 11, a sheet conveying unit 20, a fixing unit 30, a document reader 40, and an operation display unit 50 (an example of an operating unit).

The image forming unit 11 is an example of an image forming unit and includes an image forming unit 11Y for forming a yellow (Y) image, an image forming unit 11M for forming a magenta (M) image, an image forming unit 11C for forming a cyan (C) image, and an image forming unit 11K for forming a black (K) image. The Y, M, C, and K colors are basic colors described in the present embodiment.

The image forming unit 11Y includes a photoreceptor drum Y, a charging unit 12Y installed around the photoreceptor drum Y, an optical writing unit 13Y having a laser diode 130Y, a developing device 14Y (an example of a developing unit), and a drum cleaner 15Y. Similarly, the image forming units 11M, 11C, and 11K include photoreceptor drums M, C, and K, charging units 12M, 12C, and 12K installed around the photoreceptor drums M, C, and K, optical writing units 13M, 13C, and 13K having laser diodes 130M, 130C, and 130K, developing devices 14M, 14C, and 14K (an example of developing units), and drum cleaners 15M, 15C, and 15K.

A surface of the photoreceptor drum Y is uniformly charged by the charging unit 12Y. A latent image is formed on the photoreceptor drum Y by scanning exposure by the laser diode 130Y of the optical writing unit 13Y. The developing device 14Y visualizes the latent image formed on the photoreceptor drum Y by developing the latent image using toner. By this process, an image (toner image) of a predetermined color corresponding to yellow is formed on the photoreceptor drum Y.

Similarly, a surface of the photoreceptor drum M is uniformly charged by the charging unit 12M. A latent image is formed on the photoreceptor drum M by scanning exposure by the laser diode 130M of the optical writing unit 13M. The developing device 14M visualizes the latent image formed on the photoreceptor drum M by developing the latent image using toner. By this process, a toner image of a predetermined color corresponding to magenta is formed on the photoreceptor drum M.

A surface of the photoreceptor drum C is uniformly charged by the charging unit 12C. A latent image is formed on the photoreceptor drum C by scanning exposure by the laser diode 130C of the optical writing unit 13C. The developing device 14C visualizes the latent image formed on the photoreceptor drum C by developing the latent image using toner. By this process, a toner image of a predetermined color corresponding to cyan is formed on the photoreceptor drum C.

A surface of the photoreceptor drum K is uniformly charged by the charging unit 12K. A latent image is formed on the photoreceptor drum K by scanning exposure by the laser diode 130K of the optical writing unit 13K. The developing device 14K visualizes the latent image formed on the photoreceptor drum K by developing the latent image using toner. By this process, a toner image of a predetermined color corresponding to black is formed on the photoreceptor drum K. When the developing devices 14Y, 14M, 14C, and 14K are not distinguished from each other, the developing devices 14Y, 14M, 14C, and 14K are hereinafter referred to as "developing devices 14" in some cases.

The toner images formed on the photoreceptor drums Y, M, C, and K are sequentially transferred onto predetermined positions on the endless intermediate transfer belt 16 by primary transfer rollers 17Y, 17M, 17C, and 17K. The toner images, transferred to the intermediate transfer belt 16, of the colors are transferred by a secondary transferring unit 18 onto the sheet S conveyed by the sheet conveying unit 20 at predetermined time.

A fixing unit 30 (an example of a fixing unit) is installed on the side on which the sheet is discharged in the secondary transferring unit 18. The fixing unit 30 presses and heats the sheet S while conveying the sheet S and fixes the transferred toner images onto the sheet S. The fixing unit 30 is composed of a pair of a heating roller 31 (heating member) and a pressing roller 32 (pressing member). The heating roller 31 includes a heater 33 serving as a heating source for heating the heating roller 31. The heating roller 31 and the pressing roller 32 can be in contact with each other and are separable from each other. A fixing nip portion is formed as a pressure-contact portion at a position where the heating roller 31 and the pressing roller 32 are in contact with each other.

The document reader 40 causes an optical system of a scanning exposure device to scan and expose a document image and causes a line image sensor to read light reflected from the document image to acquire an image signal. The image forming apparatus body 10 may include, on the image forming apparatus body 10, an automatic document conveying device (not shown) for feeding a document sheet.

The operation display unit 50 includes a liquid crystal display (LCD) 51, a touch panel covering the LCD 51, various switches, buttons, a numeric keypad, and a group of operational keys. The operation display unit 50 receives an operation of a user and generates an operational signal based on details of the operation. The operation display unit 50 displays, on the LCD 51, an operational screen based on a display signal received from a control device 100 (refer to FIG. 6).

The sheet conveying unit 20 includes a plurality of sheet feeding trays 21 for storing sheets S, and a feeding unit 21*a* for feeding the sheets S stored in the sheet feeding trays 21. The sheet conveying unit 20 includes a main conveyor path 23 on which the sheets S fed from the sheet feeding trays 21 are conveyed, and a reverse conveyor path 24 for reversing front and back surfaces of each of the sheets S.

The sheet conveying unit 20 further includes a switching gate 23*a* at a branching position where the reverse conveyor path 24 is branched from the main conveyor path 23 on the downstream side of the fixing unit 30. In the image forming apparatus body 10, an image is formed on a surface that faces upward, of the sheet S that has been conveyed on the main conveyor path 23 and has passed through the secondary transferring unit 18 and the fixing unit 30. When images are to be formed on both surfaces of the sheet S, the sheet S with a surface that faces upward and on which an image has been formed is conveyed from the main conveyor path 23 to the reverse conveyor path 24 and conveyed from the reverse conveyor path 24 to the main conveyor path 23 so that the surface on which the image has been formed faces downward. By this process, the upper and lower surfaces of the sheet S are reversed and an image can be formed on the other surface facing upward.

The post-processing device 60 connectable to the main conveyor path 23 is arranged on a rear side of the image forming apparatus body 10. The post-processing device 60 performs a post-process on the sheet S on which a toner image supplied from the fixing unit 30 has been formed. The post-processing device 60 includes various post-processing units (not illustrated) such as a sorting unit, a stapling unit, a punching unit, and a folding unit. The post-processing device 60 performs various post-processes on the sheet S discharged from the image forming apparatus body 10 and discharges the sheet S subjected to the post-processes to a sheet discharge tray 25.

An inline sensor 61 (an example of a reader) for reading an image (output image) formed on the sheet S conveyed from the image forming apparatus body 10 is installed above a conveyor path extending from a carrying-in port provided for sheets S and included in the post-processing device 60 to the sheet discharge tray 25. The inline sensor 61 is installed above the conveyor path and reads an image formed on the upper surface of the conveyed sheet S.

As the inline sensor 61, a line sensor having a plurality of photoelectric conversion elements (not illustrated) arranged in a linear fashion across an entire sheet region extending in a width direction (main scanning direction) of the sheet is used. The width direction of the sheet is perpendicular to a conveying direction of the sheet. Alternatively, as the inline sensor 61, an image sensor having photoelectric conversion elements arranged in a matrix may be used. The inline sensor 61 irradiates an output image formed on the sheet S with beams emitted from light sources of the photoelectric conversion elements and having beam spots of a predetermined diameter. Then, the inline sensor 61 disperses light reflected from the output image into red (R), green (G), and blue (B) light and acquires information of reflectance of the R, G, and B light to read the output image and detect colors of the read image.

As each of the line sensor and the image sensor, a CCD image sensor or a CMOS image sensor (including a MOS image sensor) may be used. While the inline sensor 61 is installed above the conveyor path, another inline sensor may be installed under the conveyor path so that the line sensors read images formed on both surfaces of the sheet S during the time when the sheet S passes through the inline sensors one time. It is sufficient if the inline sensor is installed on the downstream side of the fixing unit 30 in the conveying direction of the sheet S. Thus, the inline sensor 61 may be installed in the image forming apparatus body 10.

[Hardware Configuration of Image Forming Apparatus]

Figure 5:
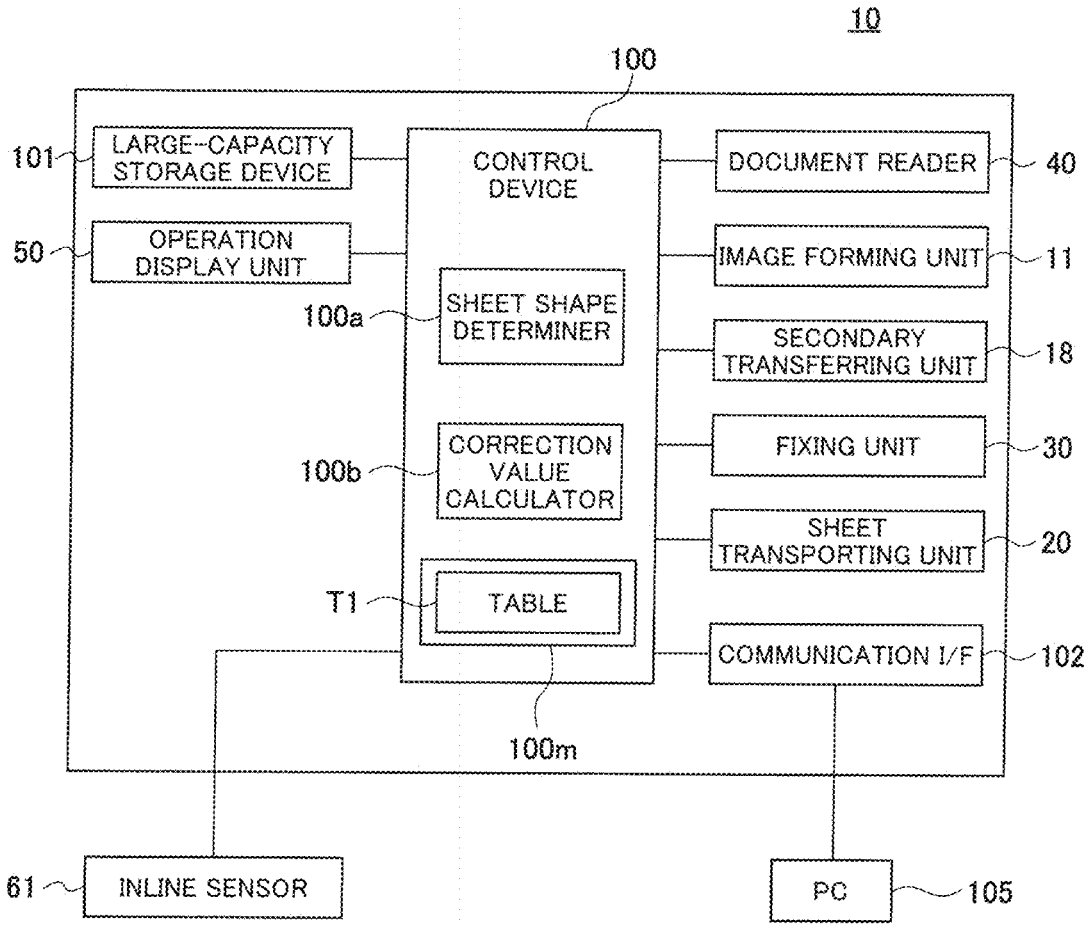
FIG. 5 is a block diagram showing an example of a hardware configuration of an image forming apparatus body according to the first embodiment of the invention.

FIG. 5 is a block diagram showing an example of a hardware configuration of the image forming apparatus body 10. FIG. 5 shows elements necessary for or related to the description of the present embodiment. A control system of the image forming apparatus is not limited to this example.

The image forming apparatus body 10 includes a control device 100 (an example of a controller) and a large-capacity storage device 101. The control device 100 controls the feeding of the sheet S, the formation of an image, and the discharging of the sheet S. The control device 100 includes an arithmetic processing device constituted by a central processing unit (CPU) not illustrated and includes memories such as a random access memory (RAM) and a read only memory (ROM). In the ROM, a program to be executed by the CPU of the control device 100, data to be used upon the execution of the program, and the like are stored. A microprocessing unit (MPU) may be used instead of the CPU.

The large-capacity storage device 101 is an example of a nonvolatile storage unit. In the large-capacity storage device 101, a parameter to be used when the program is executed by the CPU of the control device 100, data obtained by executing the program, or the like is stored. In the large-capacity storage device 101, the program to be executed by the CPU of the control device 100 may be stored. For example, a semiconductor memory, a hard disk, a solid state drive (SSD), an IC card, an SD card, a DVD, or the like is applied to the large-capacity storage device 101.

The control device 100 receives an operational signal from the operation display unit 50 and performs control based on the operational signal. The control device 100 outputs a display signal to the operation display unit 50. The operation display unit 50 displays, on the LCD 51, various setting screens for entering various operation instructions and setting information and operational screens for displaying various process results and the like.

In addition, the control device 100 acquires color information of a read image detected by the inline sensor 61 of the post-processing device 60 and uses the color information of the read image to perform color correction described later.

A communication I/F 102 is an interface that transmits and receives data to and from a personal computer (PC) 120 via a network such as a LAN or a dedicated line. The PC 120 is an operation terminal. As the communication I/F 102, a network interface card (NIC), a modem, or the like is used, for example.

A normal operation (printing operation) of the image forming apparatus body 10 to form an image on the sheet S is described below. The control device 100 controls the sheet conveying unit 20 and causes the sheet conveying unit 20 to transport the sheet S. The control device 100 controls the image forming unit 11 and the secondary transferring unit 18 based on image data acquired by the document reader 40 from a document or input image data acquired from an external and causes the image forming unit 11 and the secondary transferring unit 18 to form an output image (color toner image) on the sheet S. Then, the control device 100 controls the fixing unit 30 to cause the fixing unit 30 to fix the output image onto the sheet S and conveys the sheet S on which the output image has been formed to the post-processing device 60. The control device 100 controls the post-processing device 60 to cause the post-processing device 60 to discharge the sheet S to the sheet discharge tray 25.

In addition, the control device 100 causes the inline sensor 61 to read the output image formed on the sheet and corrects an imaging parameter (image formation requirement) for each of the basic colors based on color information of the read image.

The configuration of the control device 100 is further described below.

The control device 100 includes a sheet shape determiner 100*a*, a correction value calculator 100*b*, and a table T1. In the table T1, color change direction patterns are associated with portions determined to be recessed portions (refer to FIG. 6 in more detail). The CPU of the control device 100 reads the program from the ROM or the large-capacity storage device 101 and executes the read program, thereby enabling functions of the sections.

The sheet shape determiner 100*a* calculates a difference between color information of a read image obtained by allowing the inline sensor 61 to read a color toner image on the sheet S and color information of input image data and calculates, from the difference between the color information, a color change direction of the read image obtained from the color toner image with respect to a color of the input image data. Then, the sheet shape determiner 100*a* refers to, based on information of the color change direction, the table T1 in which the color change direction patterns are associated with the portions determined to be recessed portions, and determines a shape of a surface of the sheet S. The table T1 may be stored in the ROM not illustrated or the large-capacity storage device 101.

The sheet shape determiner 100*a* determines the shape of the surface of the sheet based on whether the color change direction of the color toner image on the sheet S with respect to the color of the input image data is a color change direction toward the printing upstream side that is the side of a basic color of a developing device 14 arranged on the upstream side in a direction in which the intermediate transfer belt 16 is driven to rotate, or is a color change direction toward the printing downstream side that is the side of a basic color of a developing device 14 arranged on the downstream side in the direction in which the intermediate transfer belt 16 is driven to rotate.

The correction value calculator 100*b* calculates a correction value to be used for the image forming unit 11 to correct a color change caused by the image forming unit 11 based on color information of a divided region (refer to FIG. 23) determined to be a protruding portion as the shape of the surface of the sheet S.

[Table in Which Color Change Direction Patterns are Associated with Portions Determined to be Recessed Portions]

FIG. 6 shows the table T1 in which the color change direction patterns are associated with the portions determined to be recessed portions. In FIG. 6, the portions determined to be recessed portions are set for the four color change direction patterns. Each of the color change direction patterns is determined based on a combination of results of analyzing detected data (color information) of 2 measurement points (corresponding to divide regions shown in FIG. 23).

A color change direction pattern (1) is a pattern in which a color change toward the printing downstream side occurs at one of 2 measurement points and a color change does not occur at the other of the 2 measurement points. In this pattern, a portion determined to be a recessed portion is a portion where the color change toward the printing downstream side occurs.

A color change direction pattern (2) is a pattern in which a color change toward the printing upstream side occurs at one of 2 measurement points and a color change does not occur at the other of the 2 measurement points. In this pattern, a portion determined to be a recessed portion is a portion where the color change does not occur.

A color change direction pattern (3) is a pattern in which only color changes toward the printing downstream side occur at 2 measurement points and the amounts of the color changes are different from each other. In this pattern, a portion determined to be a recessed portion is a portion where the amount of a color change toward the printing downstream side is larger.

A color change direction pattern (4) is a pattern in which only color changes toward the printing downstream side occur at 2 measurement points and the amounts of the color changes are the same. In the case of this pattern, since a recessed portion cannot be identified from the changes in the colors, the recessed portion is estimated from peripheral pixel information (peripheral region information).

An example in which the shape of the sheet is determined based on data detected from input image data is described below. When a threshold to be used to determine that a color at a measurement point changes is provided, the threshold may improve the accuracy of determining whether a color change occurs.

[Example of Color Change Direction Pattern (1)]

Figure 7A:
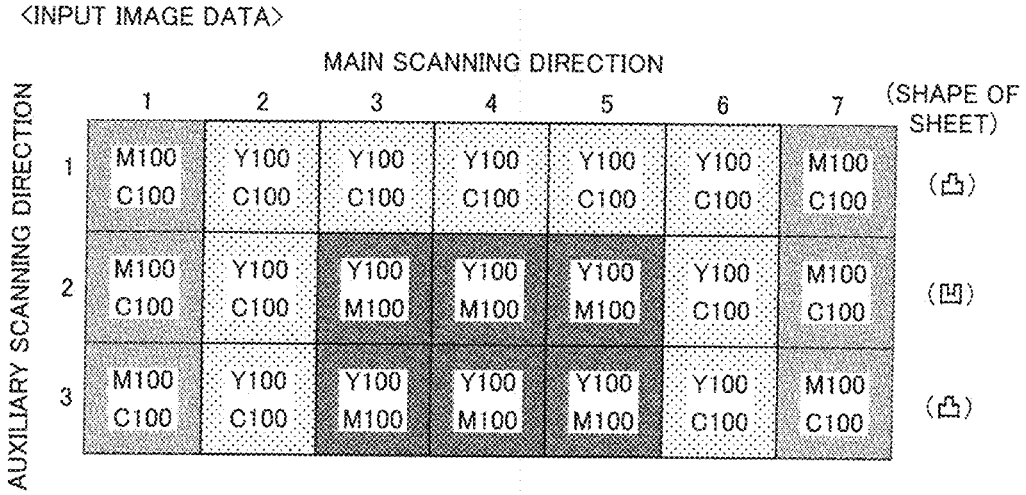
FIG. 7A is a diagram showing an example of input image data corresponding to a color change direction pattern (1)
Figure 7B:
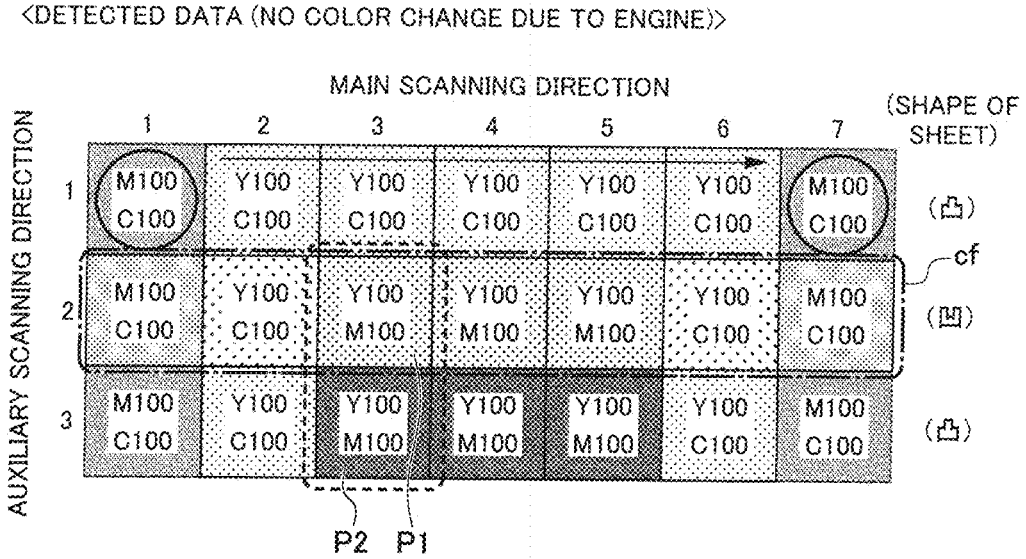
FIG. 7B is a diagram showing an example of detected data corresponding to a color change direction pattern (2)
Figure 9:
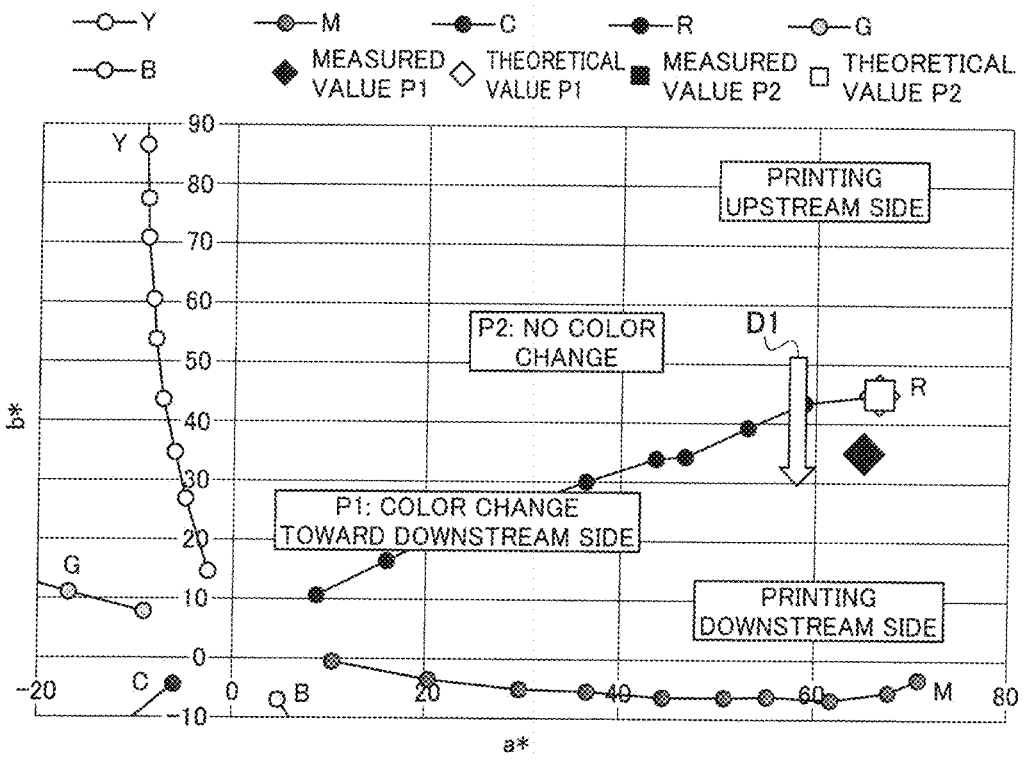
FIG. 9 is a graph showing a color change caused by recessed and protruding portions of the surface of the sheet.

First, an example of the color change direction pattern (1) is described with reference to FIG. 7A and FIG. 7B to FIG. 10. FIG. 7A shows an example of input image data corresponding to the color change direction pattern (1) and FIG. 7B shows an example of detected data corresponding to the color change direction pattern (1). FIG. 8A and FIG. 8B show examples of color information of measurement points of the detected data. FIG. 9 is a graph showing a color change caused by the recessed and protruding portions of the surface of the sheet. FIG. 10 shows a result of determining the shape of the sheet in this example.

As shown in FIG. 7A and FIG. 7B, the case where each of the input image data and the detected data (read image) has 21 divided regions formed so that 7 divided regions are arranged in a main scanning direction and 3 divided regions are arranged in an auxiliary scanning direction is described below. The divided regions may be unit pixels, respectively. Each of the divided regions may include a plurality of pixels. An n-th column extending in the main scanning direction is referred to as "n-th main scanning column", and an m-th row extending in the auxiliary scanning direction is referred to as "m-th auxiliary scanning row". In the shape of the surface of the sheet used for measurement, first and third auxiliary scanning rows are protruding portions, and a second auxiliary scanning row is a recessed portion. In FIG. 7A, in color information of the input image data, divided regions included in the third and seventh main scanning columns are of a B color (M with 100% and C with 100%). In FIG. 7A, divided regions included in the second and sixth main scanning columns, and divided regions in the third to fifth main scanning columns and the first auxiliary scanning row are of a G color (Y with 100% and C with 100%). The other divided regions are of an R color (Y with 100% and M with 100%). A measurement point P1 exists in the third main scanning column and the second auxiliary scanning row, and a measurement point P2 exists in the third main scanning column and the third auxiliary scanning row. This example assumes that a color change is not caused by the printer engine (hereinafter referred to "engine") or the image forming unit 11.

In FIG. 7B, based on the detected data of the read image, a color change cf occurs in each of divided regions included in the second auxiliary scanning row. Color information (L*a*b* values in this example) of the measurement points P1 and P2 is shown in FIG. 8A and FIG. 8B. At the measurement point P1, a color phase (Hue) decreases from a theoretical value "34.0" to a measured value "28.3" as indicated by a broken line and a color change toward the printing downstream side is detected. At the measurement point P2, theoretical values are equal to measured values, and a color change does not occur.

In a graph shown in FIG. 9, as indicated by an arrow D1, a measured value of the color phase at the measurement point P1 changes toward the printing downstream side. At the measurement point P2, a color change does not occur.

As indicated by the result of determining the shape of the sheet in FIG. 10, based on the detected data of the 2 measurement points P1 and P2, this example is determined to correspond to the color change direction pattern (1) in which a color change toward the printing downstream side occurs and a color change does not occur. Since the color change toward the printing downstream side occurs at the measurement point P1, the measurement point P1 is determined to be a recessed portion. If color changes are caused by the image forming unit 11, the color changes occur at both the measurement points P1 and P2. However, the color change (toward the printing downstream side) occurs only at the measurement point P1.

[Example of Color Change Direction Pattern (2)]

Figure 11A:
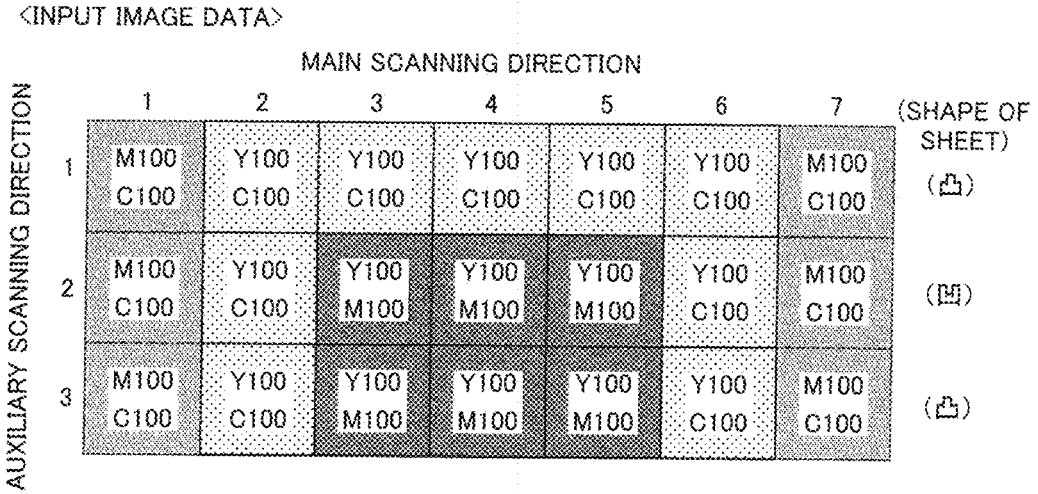
FIG. 11A is a diagram showing an example of input image data corresponding to the color change direction pattern (2)
Figure 11B:
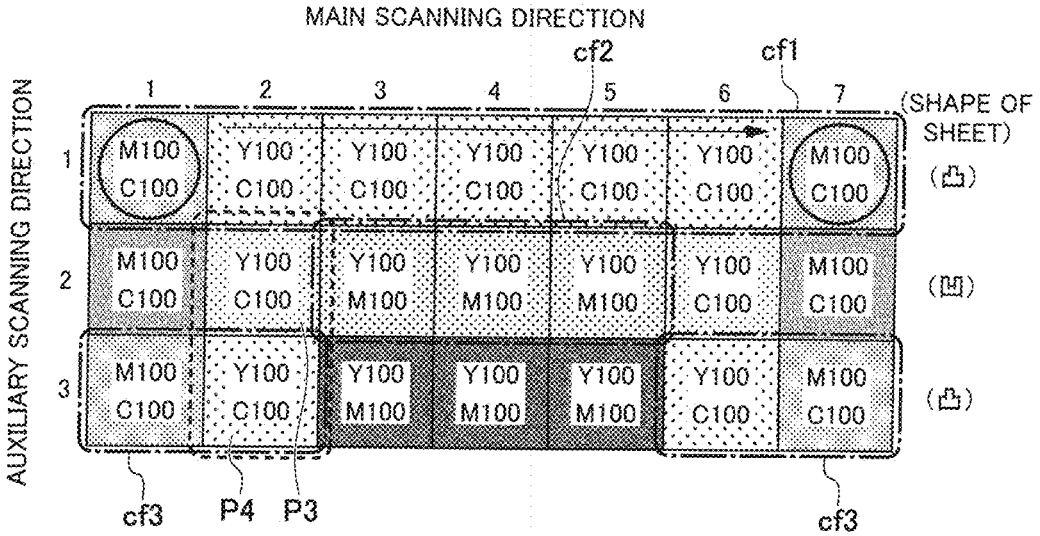
FIG. 11B is a diagram showing an example of detected data corresponding to the color change direction pattern (2)
Figure 13:
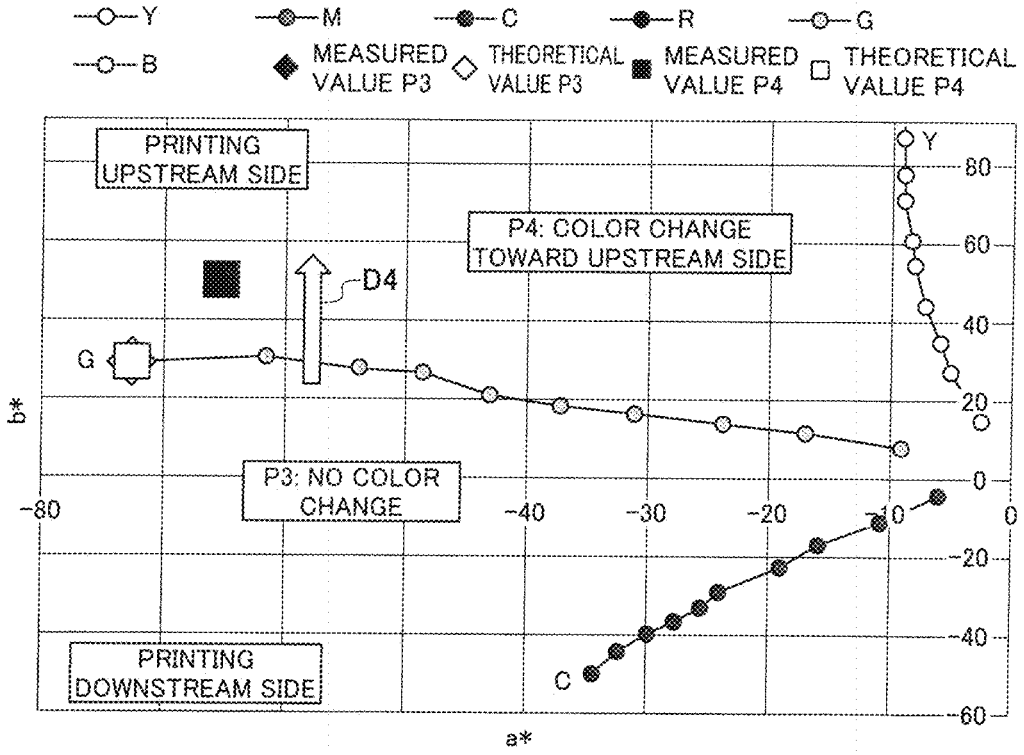
FIG. 13 is a graph showing a color change caused by the recessed and protruding portions of the surface of the sheet.

Next, an example of the color change direction pattern (2) is described with reference to FIG. 11A and FIG. 11B to FIG. 14. FIG. 11A shows an example of input image data corresponding to the color change direction pattern (2) and FIG. 11B shows an example of detected data corresponding to the color change direction pattern (2). FIG. 12A and 12B show examples of color information of measurement points of the detected data. FIG. 13 is a graph showing a color change caused by the recessed and protruding portions of the surface of the sheet. FIG. 14 shows a result of determining the shape of the sheet in this example.

The input image data and the detected data (read image) that are shown in FIG. 11A and FIG. 11B have the same configuration as those shown in FIG. 7A and FIG. 7B and each have 21 divided regions formed so that 7 divided regions are arranged in the main scanning direction and 3 divided regions are arranged in the auxiliary scanning direction. The surface of the sheet used for measurement has protruding portions in first and third auxiliary scanning rows and a recessed portion in a second auxiliary scanning row. In addition, color information of the input image data shown in FIG. 11A is the same as that shown in FIG. 7A. A measurement point P3 exists in a second main scanning column and the second auxiliary scanning row. A measurement point P4 exists in the second main scanning column and the third auxiliary scanning row. This example assumes that a color change (or a reduction in the amount of attached cyan toner) is caused by the engine or the image forming unit 11.

In FIG. 11B, a color change cf1 occurs in each of divided regions included in the first auxiliary scanning row, a color change cf2 occurs in each of divided regions included in the second auxiliary scanning row and the third to fifth main scanning columns, and a color change cf3 occurs in each of divided regions included in the third auxiliary scanning row and the first and second main scanning columns and included in the third auxiliary scanning row and the sixth and seventh main scanning columns. Color information (L*a*b* values) of the measurement points P3 and P4 is shown in FIG. 12A and FIG. 12B. At the measurement point P3, theoretical values are equal to measured values, and a color change does not occur. At the measurement point P4, a color phase (Hue) decreases from a theoretical value "158.3" to a measured value "142.3", and a color change toward the printing upstream side is detected.

In a graph shown in FIG. 13, as shown in an arrow D4, the measured value of the color phase at the measurement point P4 changes toward the printing upstream side. At the measurement point P3, a color change does not occur.

As indicated by the result of determining the shape of the sheet in FIG. 14, based on the detected data of the 2 measurement points P3 and P4, this example is determined to correspond to the color change direction pattern (2) in which a color change toward the printing upstream side occurs and a color change does not occur. Since a color change does not occur at the measurement point P3, the measurement point P3 is determined to be a recessed portion. If the sheet S is flat, a C component decreases in amount at each of the measurement points P3 and P4 and a color change toward the printing upstream side occurs at each of the measurement points P3 and P4. However, the color change toward the printing upstream side occurs only at the measurement point P4. Specifically, a divided region at the measurement point P4 is likely to be a protruding portion. On the other hand, since the measurement point P3 is the recessed portion, a C component and a Y component decrease in amount at the measurement point P3. Thus, the color change toward the printing upstream side due to the decrease in the amount of the C component and the color change toward the printing downstream side due to the decrease in the amount of the Y component offset each other, and as a result, a color change is hardly seen.

[Example of Color Change Direction Pattern (3)]

Figure 15A:
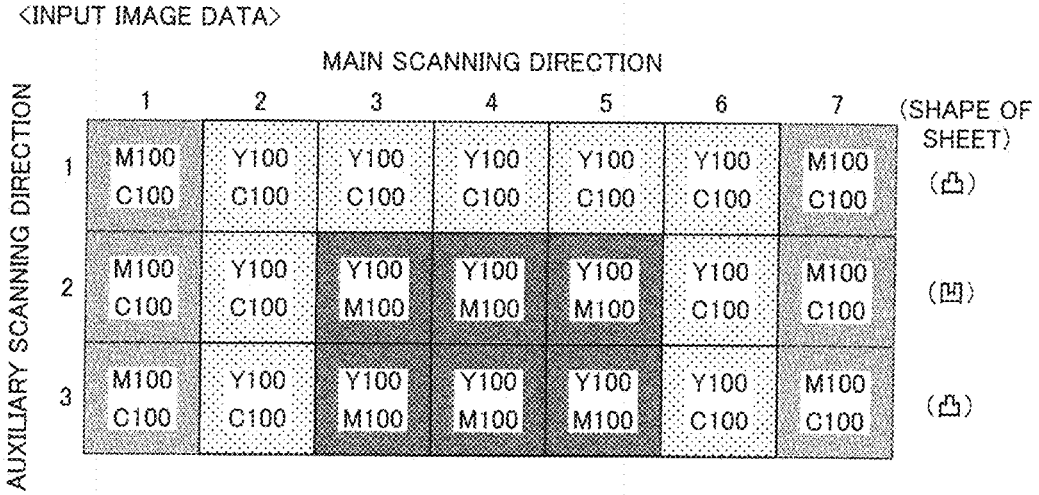
FIG. 15A is a diagram showing an example of input image data corresponding to a color change direction pattern (3)
Figure 15B:
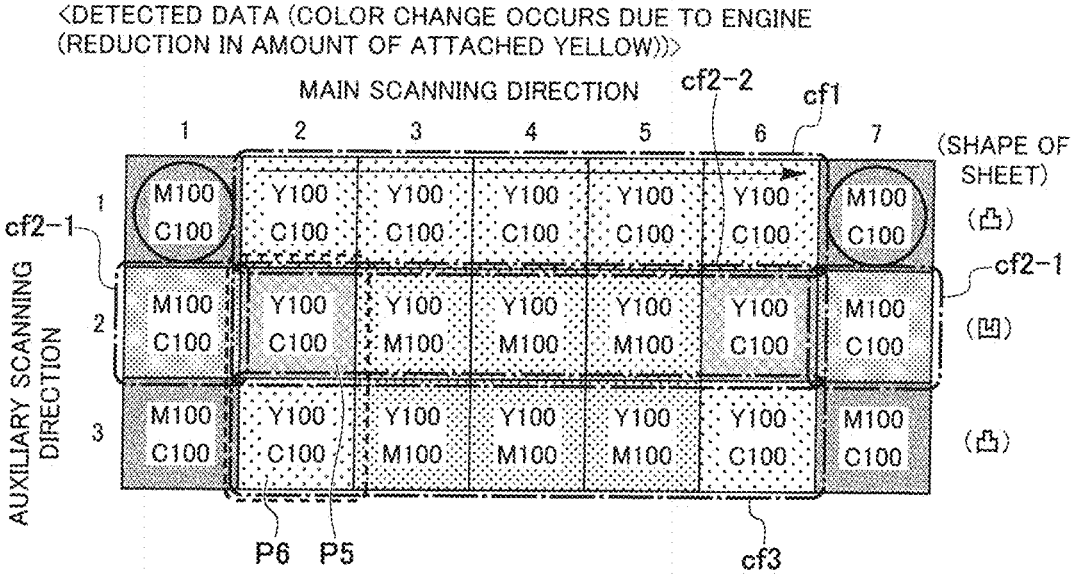
FIG. 15B is a diagram showing an example of detected data corresponding to the color change direction pattern (3)
Figure 17:
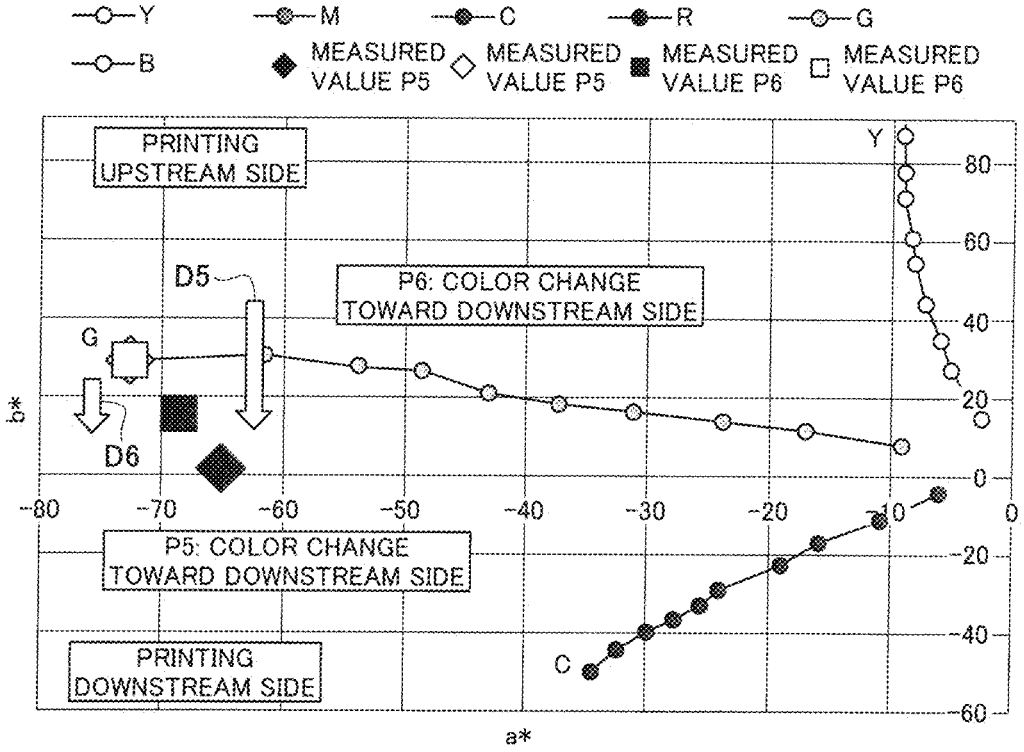
FIG. 17 is a graph showing color changes caused by the recessed and protruding portions of the surface of the sheet.

Next, an example of the color change direction pattern (3) is described with reference to FIG. 15A and FIG. 15B to FIG. 18. FIG. 15A shows an example of input image data corresponding to the color change direction pattern (3) and FIG. 15B shows an example of detected data corresponding to the color change direction pattern (3). FIG. 16A and FIG. 16B show examples of color information of measurement points of the detected data. FIG. 17 is a graph shown a color change caused by the recessed and protruding portions of the surface of the sheet. FIG. 18 shows a result of determining the shape of the sheet in this example.

The input image data and the detected data (read image) that are shown in FIG. 15A and FIG. 15B have the same configuration as those shown in FIG. 7A and FIG. 7B and each have 21 divided regions formed so that 7 divided regions are arranged in the main scanning direction and 3 divided regions are arranged in the auxiliary scanning direction. The surface of the sheet used for measurement has protruding portions in first and third auxiliary scanning rows and a recessed portion in a second auxiliary scanning row. In addition, as shown in FIG. 15A, color information of the input image data is the same as that shown in FIG. 7A. A measurement point P5 exists in a second main scanning column and the second auxiliary scanning row. A measurement point P6 exists in the second main scanning column and the third auxiliary scanning row. This example assumes that a color change (or a reduction in the amount of attached yellow toner) is caused by the engine or the image forming unit 11.

In FIG. 15B, based on the detected data of the read image, a color change cf1 occurs in each of divided regions included in the first auxiliary scanning row and second to sixth main scanning columns, a color change cf2-1 occurs in each of divided regions included in the second auxiliary scanning row and the first and seventh main scanning columns, a color change cf2-2 occurs in each of divided regions included in the second auxiliary scanning row and the second to sixth main scanning columns, and a color change cf3 occurs in each of divided regions included in the third auxiliary scanning row and the second to sixth main scanning columns. Color information (L*a*b* values) of the measurement points P5 and P6 is shown in FIG. 16A and FIG. 16B. At the measurement point P5, a color phase (Hue) increases from a theoretical value "158.3" to a measured value "178.8" as indicated by a broken line, and a color change toward the printing downstream side is detected. At the measurement point P6, a color phase (Hue) increases from a theoretical value "158.3" to a measured value "168.3" as indicated by a broken line, and a color change toward the printing downstream side is detected.

In a graph shown in FIG. 17, as indicated by an arrow D5, a measured value of the color phase at the measurement point P5 significantly changes toward the printing downstream side. In addition, as indicated by an arrow D6, a measured value of the color phase at the measurement point P6 changes toward the printing downstream side. The amounts of the changes at the measurement points P5 and P6 are represented by lengths of the arrows D5 and D6. In the present embodiment, since the length of the arrow D5 is longer than the length of the arrow D6, it is apparent that the amount of the change at the measurement point P5 is larger.

As indicated by the result of determining the shape of the sheet in FIG. 18, based on the detected data of the 2 measurement points P5 and P6, this example is determined to correspond to the color change direction pattern (3) in which only color changes toward the printing downstream side occur and the amounts of the changes in the colors are different from each other. In addition, since the amount of the color change toward the printing downstream side at the measurement point P5 is larger, the measurement point P5 is determined to be a recessed portion. If a color change is caused by the image forming unit 11, the amounts of changes in colors at the measurement points P5 and P6 are equal to or close to each other. In fact, however, the amount of the change in the color at the measurement point P5 is larger. This is considered to be due to the fact that the measurement point P5 is affected by not only the image forming unit 11 but also the shape (recessed portion) of the surface of the sheet.

[Example of Color Change Direction Pattern (4)]

Figure 19A:
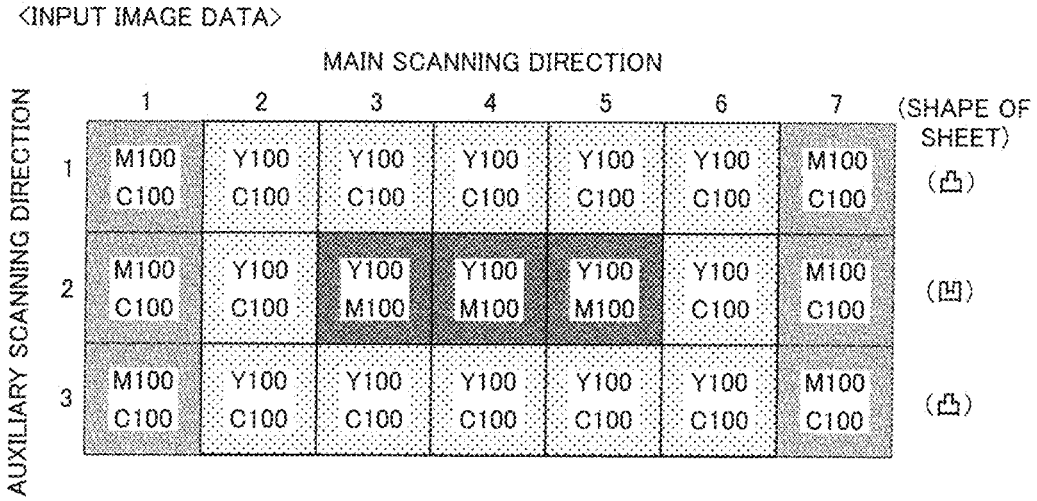
FIG. 19A is a diagram showing an example of input image data corresponding to a color change direction pattern (4)
Figure 19B:
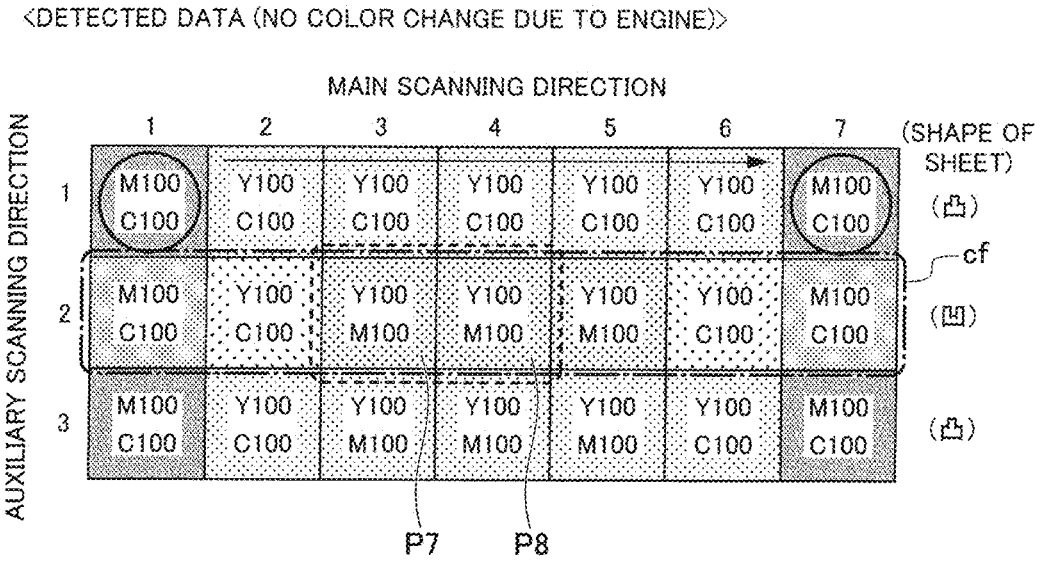
FIG. 19B is a diagram showing an example of detected data corresponding to the color change direction pattern (4)
Figure 21:
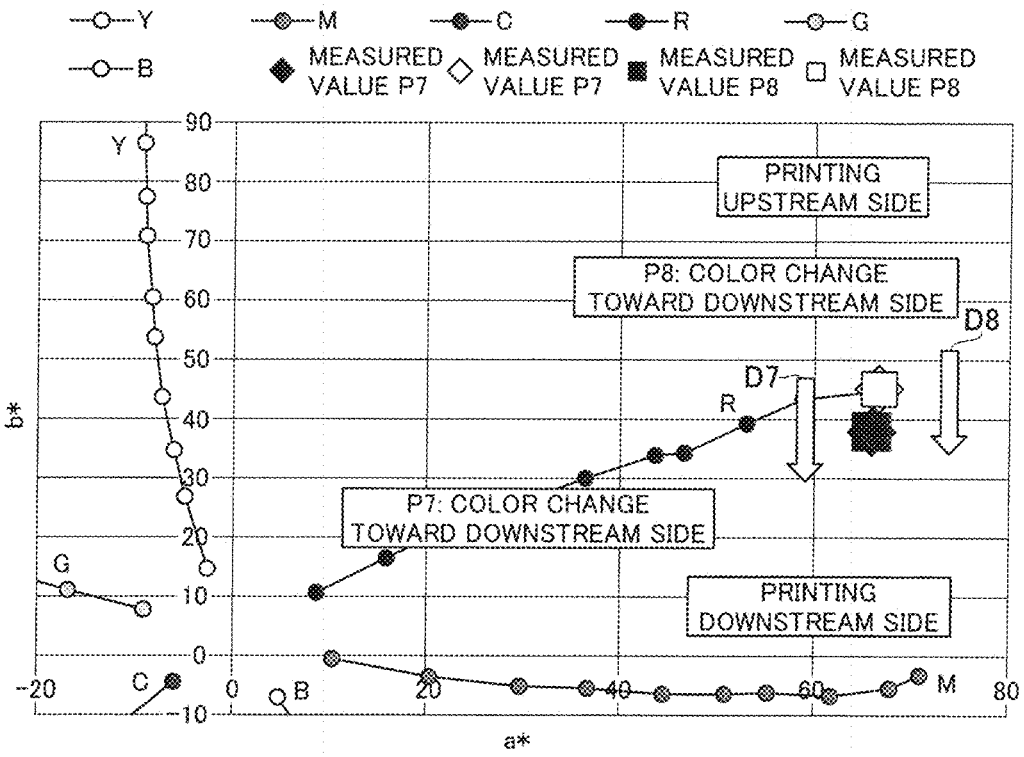
FIG. 21 is a graph showing color changes caused by the recessed and protruding portions of the surface of the sheet.

Next, an example of the color change direction pattern (4) is described with reference to FIG. 19A and FIG. 19B to FIG. 22. FIG. 19A shows an example of input image data corresponding to the color change direction pattern (4) and FIG. 19B shows an example of detected data corresponding to the color change direction pattern (4). FIG. 20A and FIG. 20B show examples of color information of measurement points of the detected data. FIG. 21 is a graph showing a color change caused by the recessed and protruding portions of the surface of the sheet. FIG. 22 shows a result of determining the shape of the sheet in this example.

The input image data and the detected data (read image) that are shown in FIG. 19A and FIG. 19B have the same configuration as those shown in FIG. 7A and FIG. 7B. Each of the input image data and the detected data has 21 divided regions formed so that 7 divided regions are arranged in the main scanning direction and 3 divided regions are arranged in the auxiliary scanning direction. The surface of the sheet used for measurement has protruding portions in first and third auxiliary scanning rows and a recessed portion in a second auxiliary scanning row. In addition, color information of the input image data shown in FIG. 19A and FIG. 19B are different from that shown in FIG. 7A in that divided regions included in the second auxiliary scanning row and third to fifth main scanning columns are of an R color (Y with 100% and M with 100%). A measurement point P7 exists in the third main scanning column and the second auxiliary scanning row, and a measurement point P8 exists in the fourth main scanning column and the second auxiliary scanning row. This example assumes that a color change does not occur due to the engine or the image forming unit 11.

In FIG. 19B, based on the detected data of the read image, a color change cf occurs in each of divided regions included in the second auxiliary scanning row. Color information (L*a*b* values) of the measurement points P7 and P8 is shown in FIG. 20A and FIG. 20B. At the measurement point P7, a color phase (Hue) decreases from a theoretical value "34.0" to a measured value "30.1" as indicated by a broken line, and a color change toward the printing downstream side is detected. At the measurement point P8, a color phase (Hue) decreases from a theoretical value "34.0" to a measured value "30.1" as indicated by a broken line, and a color change toward the printing downstream side is detected. It is apparent that the amounts of the color changes at the measurement points P7 and P8 are the same.

In a graph shown in FIG. 21, as indicated by an arrow D7, a measured value of the color phase at the measurement point P7 changes toward the printing downstream side. In addition, as indicated by an arrow D8, a measured value of the color phase at the measurement point P8 changes toward the printing downstream side. Since lengths of the arrows D7 and D8 are the same, it is apparent that the amounts of the changes at the measurement points P7 and P8 are the same.

As indicated by the result of determining the shape of the sheet in FIG. 22, based on the detected data of the 2 measurement points P7 and P8, this example is determined to correspond to the color change direction pattern (4) in which only color changes toward the printing downstream side occur and the amounts of the color changes are the same. Since the amounts of the color changes are the same, the measurement points P7 and P8 are likely to have the same shape, but a recessed portion cannot be determined based on the color changes. In this case, the sheet shape determiner 100*a* determines the shapes of the measurement points based on information (for example, peripheral pixel information) on the shapes of divided regions existing around the measurement points.

[Read Regions (Divided Regions)]

Figure 23:
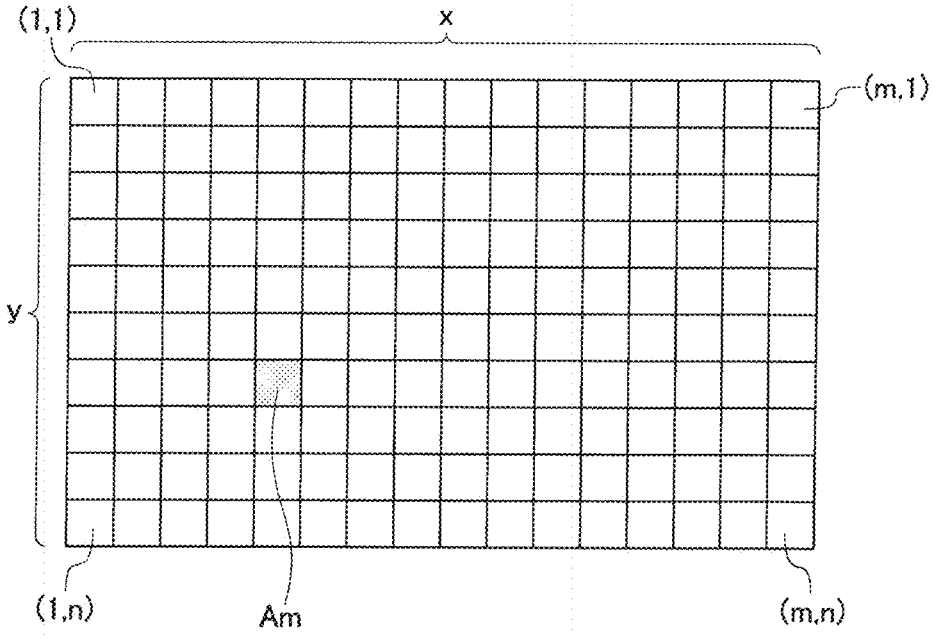
FIG. 23 is a diagram showing read regions (divided regions) generated by dividing a read image acquired from a color toner image on the sheet into a plurality of regions.

FIG. 23 shows read regions (divided regions) generated by dividing a read image acquired from a color toner image on the sheet S into a plurality of regions. As described above, when data (color phase) of the same gradation level exists in regions (either recessed portions or protruding portions) having the same shape, the shapes of the regions cannot be determined based on a color change direction, and the sheet shape determiner 100*a* (refer to FIG. 5) determines (estimates) the shape of a target divided region based on results (shapes) of determining divided regions existing around the target divided region. As shown in FIG. 23, a lattice-shaped read region Am is set as a reading unit of the output image (color toner image). In an example shown in FIG. 23, the output image is divided into a number m×n of divided regions formed so that a number m of divided regions are arranged in an x direction (main scanning direction) and a number of n divided regions are arranged in a y direction (auxiliary scanning direction).

[Determination Based on Periodicity of Recessed and Protruding Portions of Sheet Surface]

As a first example of a method of determining the shape of a target divided region based on a result (shape) of determining a divided region existing around the target divided region, a method of determining the shape based on the periodicity of the shape of the surface of the sheet is described below.

Figure 24:
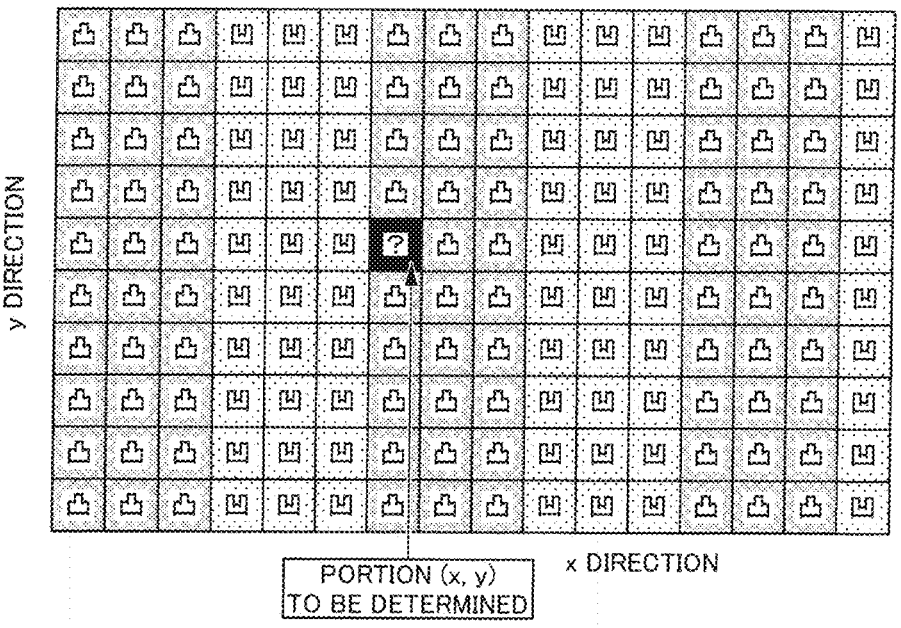
FIG. 24 is a diagram showing an example in which the shape of the surface of the sheet is determined based on the periodicity of the recessed and protruding portions of the surface of the sheet.

FIG. 24 shows an example in which the shape of the surface of the sheet is determined based on the periodicity of the recessed and protruding portions of the surface of the sheet. The sheet shape determiner 100*a* analyzes results (color information) of measuring an image read from an output image (color toner image) using a column extending in the x direction (main scanning direction) or a row extending in the y direction (auxiliary scanning direction) and determines the shape of a target region (indicated by ? and to be determined) based on the periodicity of the shape of the analyzed sheet surface. In FIG. 24, in the column in the y direction in which the target region to be determined exists, the sheet shape determiner 100*a* determines that regions other than the target region to be determined are determined to be "protruding portions". Thus, the sheet shape determiner 100*a* determines that the target region is also a protruding portion.

Information of the periodicity can be acquired by a method such as user's manual input using the operation display unit 50 or pre-detection. The information of the periodicity is stored, as the setting of the sheet S stored in a sheet feeding tray 21 of the image forming apparatus body 10, in the large-capacity storage device 101. In general, the periodicity of cross-sectional recessed streaks formed on the sheet and the periodicity of cross-sectional protruding streaks formed on the sheet are in a range of 0.3 mm to 5 mm. The information of the periodicity of the shape of the surface of the sheet is described on a packing sheet for the purchased sheet S or the like.

[Determination Based on Number of Recessed Portions and Number of Protruding Portions Among Peripheral Divided Regions]

As a second example of a method of determining the shape of a target divided region based on a result (shape) of determining a divided region existing around the target divided region, a method of determining the shape based on the number of recessed portions and the number of protruding portions among divided regions existing around the target divided region.

Figure 25A:
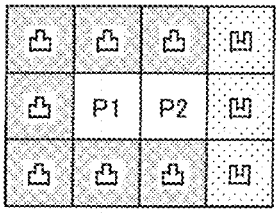
FIG. 25A is a diagram showing an example of a read image in which divided regions are formed so that 3 divided regions are arranged in a vertical direction and 4 divided regions are arranged in a horizontal direction.

FIG. 25A to FIG. 25E show an example of the determination of the shape of the surface of the sheet based on the number of divided regions determined to be recessed portions existing around the target divided region and the number of divided regions determined to be protruding portions existing around the target divided region. FIG. 25A shows an example of a read image in which 12 divided regions are formed so that 3 divided regions area arranged in a vertical direction and 4 divided regions are arranged in a horizontal direction. In this case, divided regions P1 and P2 existing in the read image are target regions to be determined. Divided regions arranged in the rightmost column are recessed portions, and divided regions that are among the other divided regions and are not the divided regions P1 and P2 are protruding portions. A main criterion for the determination is to determine a target divided region based on the shapes of many divided regions existing around the target divided region. For example, when the number of protruding portions existing around the target divided region is larger than the number of recessed portions existing around the target divided region, the target divided region can be determined to be a "protruding portion". Details are described below.

Figure 25B:
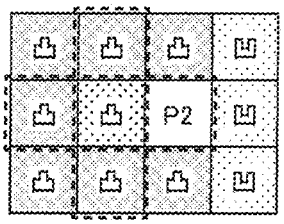
FIG. 25B is a diagram showing an example of a result of first determination of a divided region P1.

FIG. 25B shows a result of first determination of the divided region P1. Divided regions existing around the divided region P1 are three "protruding portions" (with reliability of 100%) and one region (divided region P2) indicated by "?". Thus, the sheet shape determiner 100*a* determines that the divided region P1 is a "protruding portion" (with reliability of 50%) in the first determination. The present embodiment assumes that a portion is estimated in the first determination with reliability of 50% and estimated in second and later determination with reliability of 50%. The relationships between the percentages and the number of times of the estimation can be arbitrarily set.

Figure 25C:
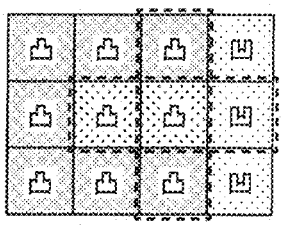
FIG. 25C is a diagram showing an example of a result of first determination of a divided region P2.

FIG. 25C shows a result of first determination of the divided region P2. Divided regions existing around the divided region P2 are two "protruding portions" (with reliability of 100%), one "protruding portion" (with reliability of 50%), and one "recessed portion" (with reliability of 100%). Thus, the sheet shape determiner 100*a* determines that the divided region P2 is a "protruding portion" (with reliability of 50%) in the first determination.

Figure 25D:
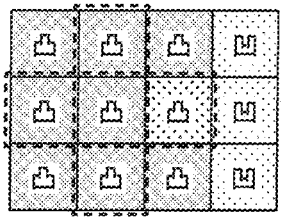
FIG. 25D is a diagram showing an example of a result of second determination of the divided region P1.

FIG. 25D shows a result of second determination of the divided region P1. The divided regions existing are the divided region P1 are three "protruding portions" (with reliability of 100%) and one "protruding portion" (with reliability of 50%). Thus, the sheet shape determiner 100*a* determines that the divided region P1 is a "protruding portion" (with reliability of 100%) in the second determination.

Figure 25E:
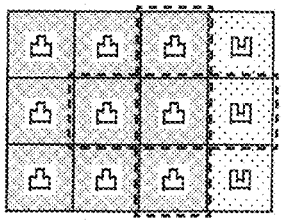
FIG. 25E is a diagram showing an example of a result of second determination of the divided region P2.

FIG. 25E shows a result of second determination of the divided region P2. The divided regions existing around the divided region P2 are three "protruding portions" (with reliability of 100%) and one "recessed portion" (with reliability of 100%). Thus, the sheet shape determiner 100*a* determines that the divided region P2 is a "protruding portion" (with reliability of 100%) in the second determination.

By repeatedly making the determination in accordance with the criteria for the determination, the shapes of the target divided regions can be estimated. The reliability (accuracy) for the determination can be increased every time the determination is repeatedly made. Divided regions existing around a target divided region may not be divided regions adjacent to the target divided region on the upper, lower, left, and right sides of the target divided region, and a range of divided regions existing around the target divided region (or the number of divided regions existing around the target divided region) may be increased. The shape of a divided region existing in an oblique direction with respect to the target divided region may be used for the determination.

According to the aforementioned first embodiment, a difference between color information of a read image obtained by reading a color toner image on the sheet S and color information of input image data is calculated, and a color change direction of the read image obtained by reading the color toner image with respect to a color of the input image data is calculated based on the difference between the color information. Then, the table in which the color change direction patterns are associated with the portions determined to be recessed portions is referred to and the shape of the surface of the sheet is determined. Thus, the color correction can be performed with high accuracy based on color information (detection result) on a user real image while an effect of the shape of the surface of the sheet is removed. Since a special image pattern (detection patch) is not used in the color correction, unnecessary consumption of toner can be suppressed and a reduction in the productivity can be prevented.

2. Second Embodiment

A second embodiment is an example in which information corresponding to a streak component and an uneven component that are included in color information (measured data) of a read image obtained by reading a color toner image on the sheet S is excluded from information to be used for determination. The image streak rg is an image defect and occurs due to dirt of a laser mirror of an exposure unit, dust attached to a surface of a photoreceptor drum, dirt or damage of the intermediate transfer belt 16, or the like and leads to a reduction in the accuracy of the shape determination.

[Case Where Periodicity Exists in Auxiliary Scanning Direction]

Figure 26:
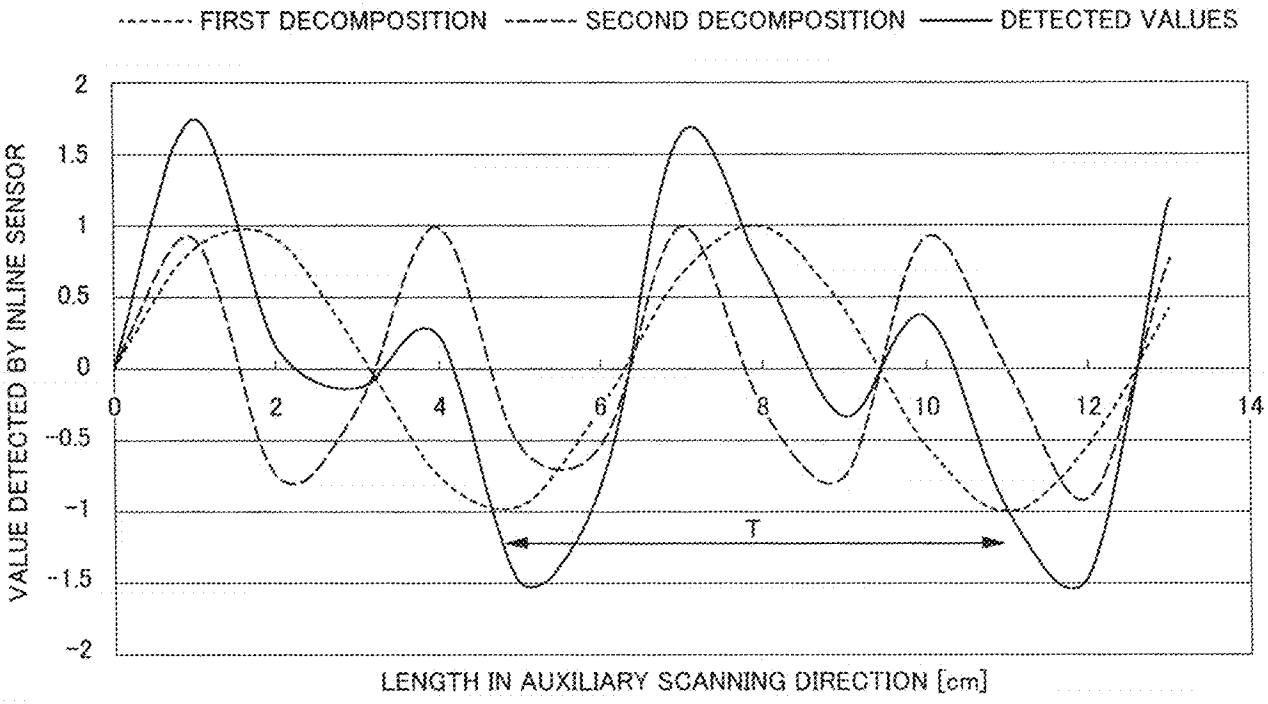
FIG. 26 is a diagram showing an example in which information, which is included in color information of a read image obtained by reading a color toner image on the sheet and indicates a periodic change component corresponding to a component installed in the apparatus and having periodicity, is removed from information to be used for determination according to a second embodiment of the invention.

FIG. 26 shows an example in which information that is included in color information of a read image obtained by reading a color toner image on the sheet S and indicates a periodic change component corresponding to a component included in the apparatus and having periodicity is excluded from information to be used for determination. In FIG. 26, an abscissa indicates a length (centimeters) in the auxiliary scanning direction and an ordinate indicates a value (normalized value) detected by the inline sensor 61.

As shown in FIG. 26, a waveform of detected values of the color information is indicated by a solid line, a waveform indicating first decomposition performed to decompose the detected values of the color information into frequencies is indicated by a fine dotted line, and a waveform indicating second decomposition performed to decompose the detected values of the color information into frequencies is indicated by a rough dotted line. The shape is determined by cross-checking the waveforms with the component having the periodicity included in the image forming apparatus body 10, and excluding a corresponding periodic change component. For example, when a period T of the waveform indicating the first decomposition matches a length of a developing roller, corresponding information among measured data (waveforms of the detected values) is excluded from the information to be used for the determination. The corresponding information may be excluded from the measured data.

Thus, the sheet shape determiner 100*a* can exclude information corresponding to a steak component and an uneven component that are caused by the component having the periodicity from the detected color information and determine the shape of the surface of the sheet. This improves the accuracy of determining the shape of the surface of the sheet by the sheet shape determiner 100*a*.

[Case Where Result of Detecting Low-Density Portion Extending to End of Sheet in Auxiliary Scanning Direction Exists]

Figure 27:
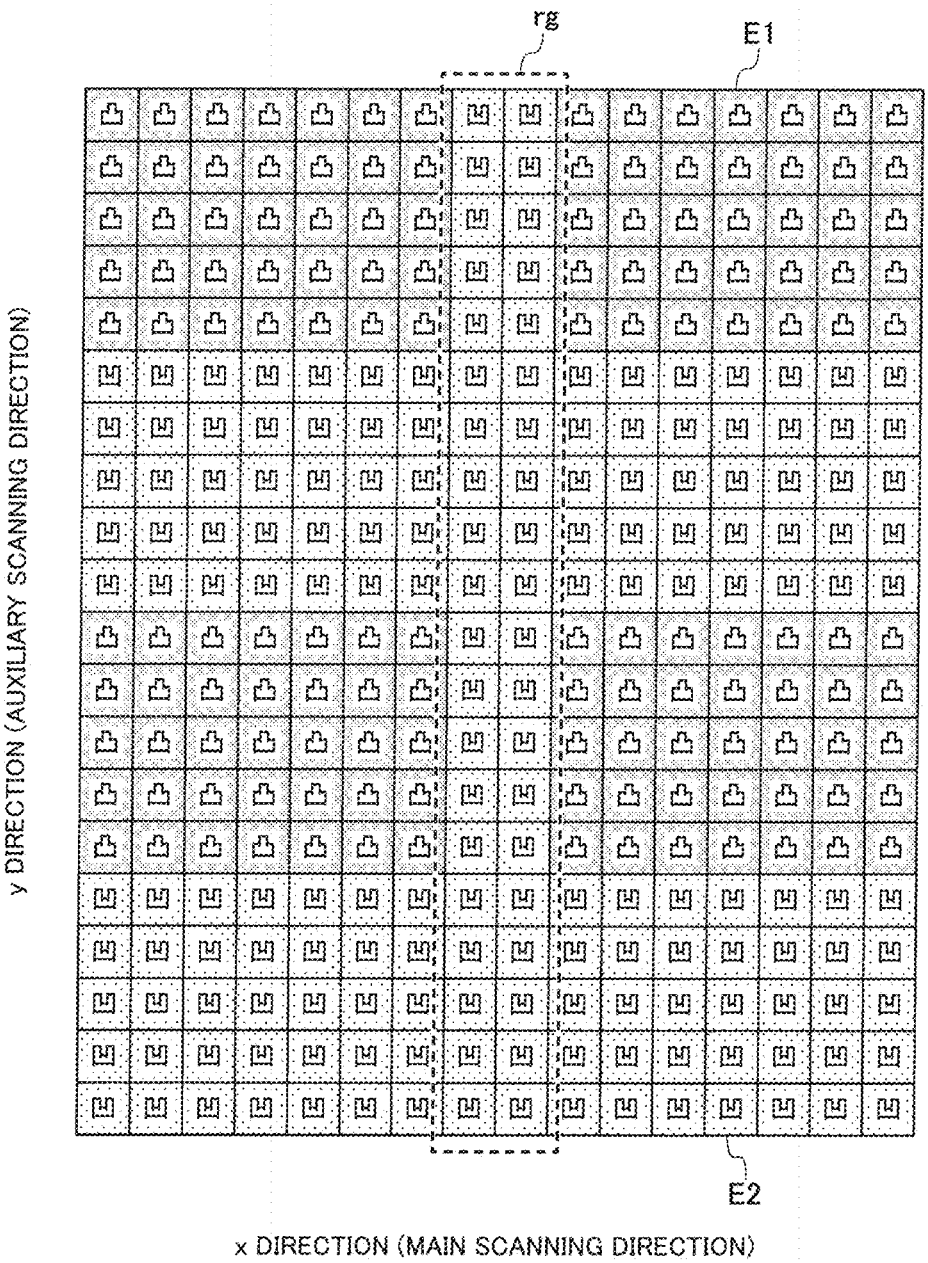
FIG. 27 is a diagram showing an example in which information, which is included in color information of a read image obtained by reading a color toner image on the sheet and corresponds to a low-density portion extending in a conveying direction of the sheet, is removed from the information to be used for the determination.

FIG. 27 shows an example in which information that is included in color information of a read image obtained by reading a color toner image on the sheet S and corresponds to a low-density portion extending in the conveying direction of the sheet S is excluded from information to be used for the determination.

In FIG. 27, a y direction of the read image indicates the auxiliary scanning direction, and an x direction of the read image indicates the main scanning direction. In addition, a front end of the read image is indicated by E1 and a rear end of the read image is indicated by E2. When a result of detecting a low-density portion extending to the end E1 corresponding to a sheet end in the auxiliary scanning direction (y direction) exists in the read image shown in FIG. 27, an image streak rg (indicated by a dotted line) is regarded to have occurred and is excluded from the information to be used for the determination. Information of this image streak may be excluded from measured data (read image).

Thus, the sheet shape determiner 100*a* can exclude, as an image streak, information included in detected color information and corresponding to a low-density portion extending in the conveying direction of the sheet, and determine the shape of the surface of the sheet. This improves the accuracy of determining the shape of the surface of the sheet by the sheet shape determiner 100*a*.

3. Third Embodiment

A third embodiment is an example in which a correction value to be used to correct a change (change caused by the image forming unit 11) caused by the engine is calculated from color information of a portion determined to be a protruding portion.

Figure 28C:
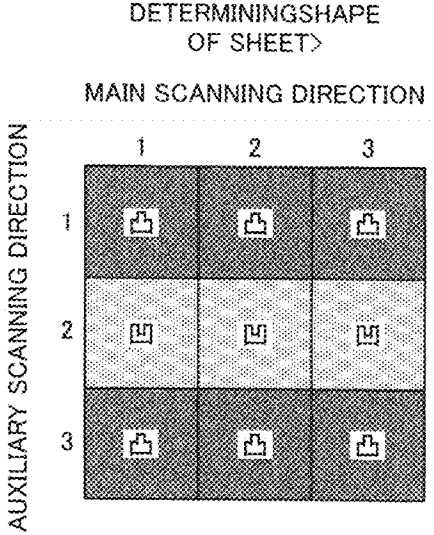
FIG. 28C is a diagram showing an example of a result of determining the shape of the sheet.
Figure 28B:
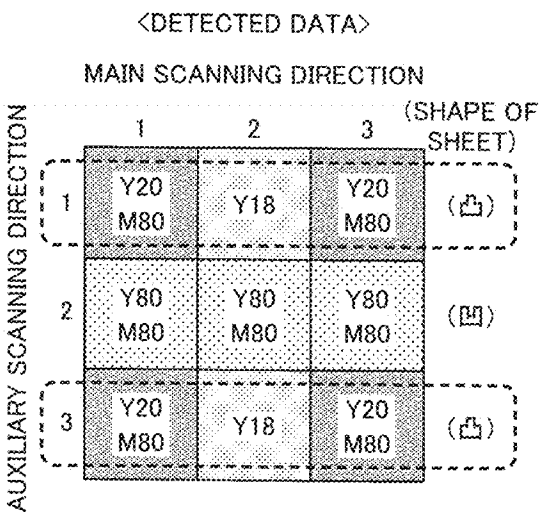
FIG. 28B is a flowchart showing an example of color information of detected data (read image)
Figure 28A:
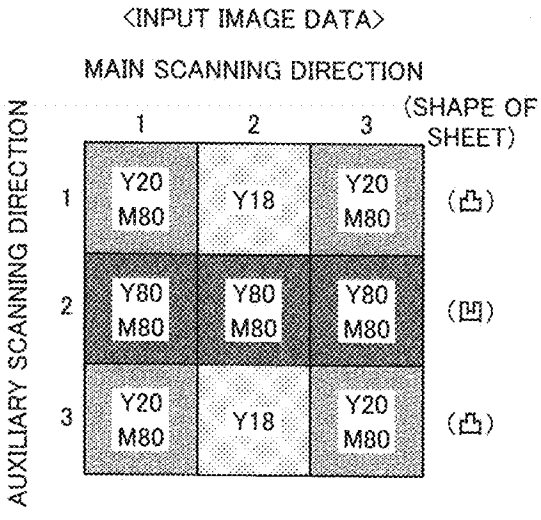
FIG. 28A is a diagram showing an example of color information of input image data according to a third embodiment of the invention.

FIG. 28A to FIG. 28C show an example in which the correction value to be used to correct a change caused by the image forming unit is calculated from color information of divided regions determined to be protruding portions according to the third embodiment. FIG. 28A shows color information of input image data. FIG. 28B shows color information of detected data (read image). FIG. 28C shows a result of determining the shape of the sheet. The correction value is calculated using color information included in the color information of the detected data and corresponding to the divided regions determined to be the protruding portions and shown in FIG. 28C.

The sheet shape determiner 100*a* determines that a difference between color information, included in the detected data (read image) shown in FIG. 28B, of divided regions determined to be protruding portions and the color information of the input image data shown in FIG. 28A is a change caused by the engine. Then, the sheet shape determiner 100*a* corrects the change caused by the engine. For example, the correction value calculator 100*b* (refer to FIG. 5) converts differences between color space coordinates (L*a*b* values) of protruding portions of the input image data and color space coordinates (L*a*b* values) of the protruding portions of the detected data (read image) to deviations of YMCK values and calculates the correction value based on the deviations of the YMCK values.

The difference between the color information may be calculated using RGB values output by the inline sensor 61. It is, however, desirable that the RGB values be converted to measured values (L*a*b*, CIEXYZ, CIECAM02, and the like) of a device-independent color space and evaluation be performed using the measured color values after the conversion in order to perform the evaluation using the measured color values close to color differences visible by a person. A method of calculating the correction value is not limited. The correction value may be calculated using a known technique.

4. Fourth Embodiment

As a fourth embodiment, a process obtained by combining the first to third embodiments is described below with reference to FIG. 29 and FIG. 30.

[Procedure for Process of Calculating Correction Value]

Figure 29:
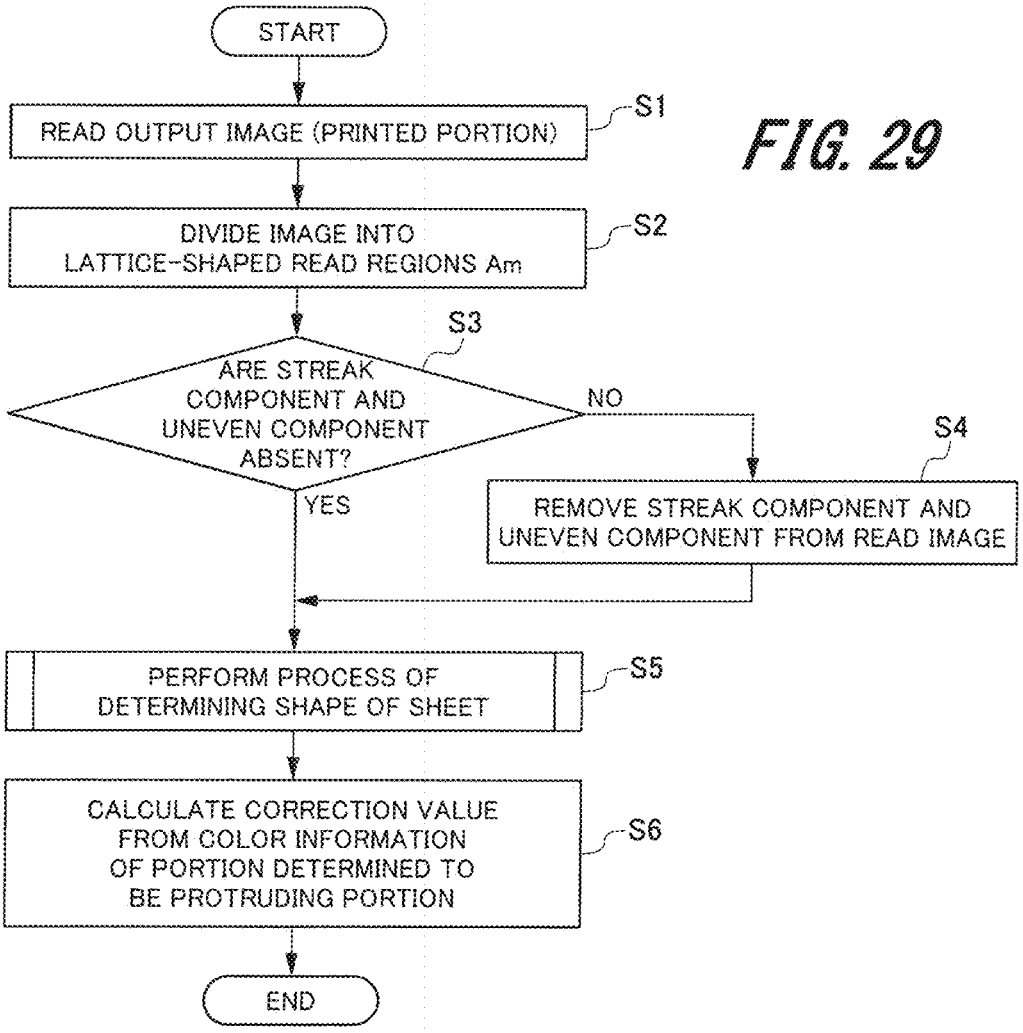
FIG. 29 is a flowchart showing a procedure for a process of calculating a correction value by a control device according to a fourth embodiment of the invention.

FIG. 29 is a flowchart showing an example of a procedure for a process of calculating the correction value by the control device 100 according to the fourth embodiment of the invention. First, the sheet shape determiner 100*a* causes the inline sensor 61 to read an output image (printed portion) formed on the sheet S based on input image data and causes data of the read image to be stored in the large-capacity storage device 101 (S1). Then, the sheet shape determiner 100*a* decomposes the read image into lattice-shaped read regions Am (refer to FIG. 23) (S2).

Then, the sheet shape determiner 100*a* confirms that a streak component and an uneven component are absent in the read image (S3) (refer to FIG. 26 and FIG. 27). When the streak component and the uneven component exist in the read image (NO in S3), the sheet shape determiner 100*a* removes the streak component and the uneven component from the read image (S4). The streak component and the uneven component may not be removed in step S4 and may be excluded from information to be used to determine the shape in a process of determining the shape of the sheet in step S5.

When the streak component and the uneven component do not exist in the read image (YES in S3) or after the process of step S4, the sheet shape determiner 100*a* performs the process of determining the shape of the sheet (S5). Then, the correction value calculator 100*b* calculates the correction value from color information of a portion determined to be a protruding portion (S6). After the process of step S6, the process of this flowchart is terminated.

[Procedure for Process of Determining Shape of Sheet]

Figure 30:
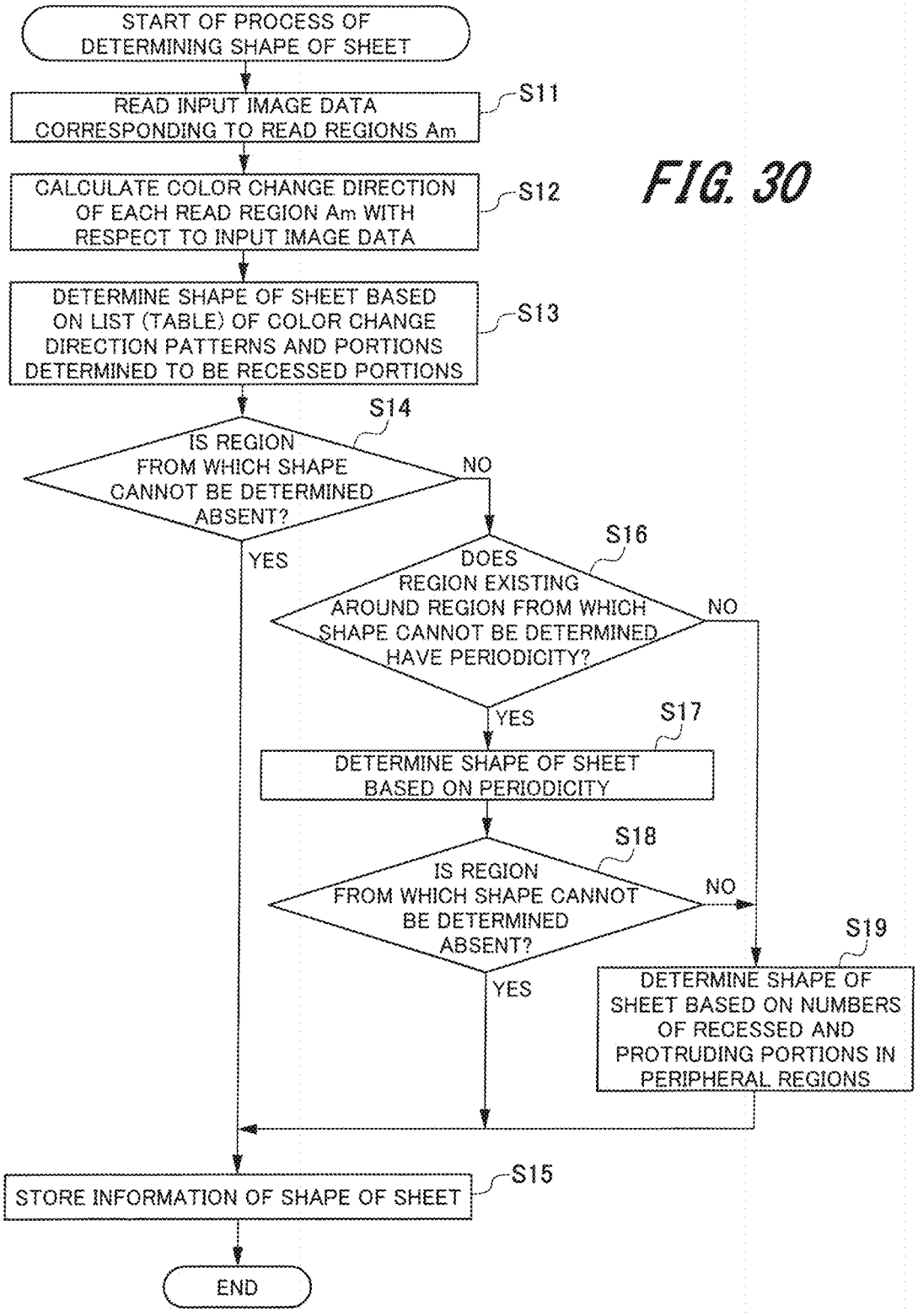
FIG. 30 is a flowchart showing an example of a procedure for a process of determining the shape of the sheet by the control device according to the fourth embodiment of the invention.

FIG. 30 is a flowchart showing an example of a procedure for the process of determining the shape of the sheet by the control device 100 according to the fourth embodiment of the invention. This flowchart indicates details of step S5 shown in FIG. 29.

First, the sheet shape determiner 100*a* reads color information of the input image data corresponding to the read regions Am (divided regions) of the read image (S11). Then, the sheet shape determiner 100*a* calculates a color change direction of each of the read regions Am with respect to a color of the input image data (S12). The sheet shape determiner 100*a* determines the shape of the surface of the sheet based on the list table (table T1 shown in FIG. 6) of the color change direction patterns and portions determined to be recessed portions (S13).

The sheet shape determiner 100*a* determines whether a read region Am from which the shape of the surface of the sheet cannot be determined is absent (S14). When the read region from which the shape of the surface of the sheet cannot be determined is absent (YES in S14), the sheet shape determiner 100*a* causes information of the shape of the surface of the sheet to be stored in the large-capacity storage device 101 (S15). After the process of step S15, the process of this flowchart is terminated.

When the read region Am from which the shape of the surface of the sheet cannot be determined exists (NO in S14), the sheet shape determiner 100*a* determines whether a read region Am existing around the read region Am from which the shape of the surface of the sheet cannot be determined has periodicity in terms of the shape of the read region Am (S16). When the read region Am has the periodicity (YES in S16), the sheet shape determiner 100*a* determines the shape of the surface of the sheet based on the periodicity (S17) (refer to FIG. 24).

Then, the sheet shape determiner 100*a* determines whether a read region Am from which the shape of the surface of the sheet cannot be determined is absent (S18). The determination is made to confirm whether non-periodic color information is included in the read image. Then, when the read region Am from which the shape of the surface of the sheet cannot be determined is absent (YES in S18), the sheet shape determiner 100*a* causes the process to proceed to step S15.

When the read region Am does not have the periodicity (NO in S16) or when the read region Am from which the shape of the surface of the sheet cannot be determined exists (NO in S18), the sheet shape determiner 100*a* determines the shape of the surface of the sheet based on the number of recessed portions and the number of protruding portions among peripheral read regions Am (S19). After the process of step S19, the sheet shape determiner 100*a* causes the process to proceed to step S15. Then, when the answer to the determination of step S18 is YES or after the process of step S19, the sheet shape determiner 100*a* causes information of the shape of the surface of the sheet to be stored in the large-capacity storage device 101 (S15). After the process of step S15, the process of this flowchart is terminated.

5. Fifth Embodiment

Figure 31:
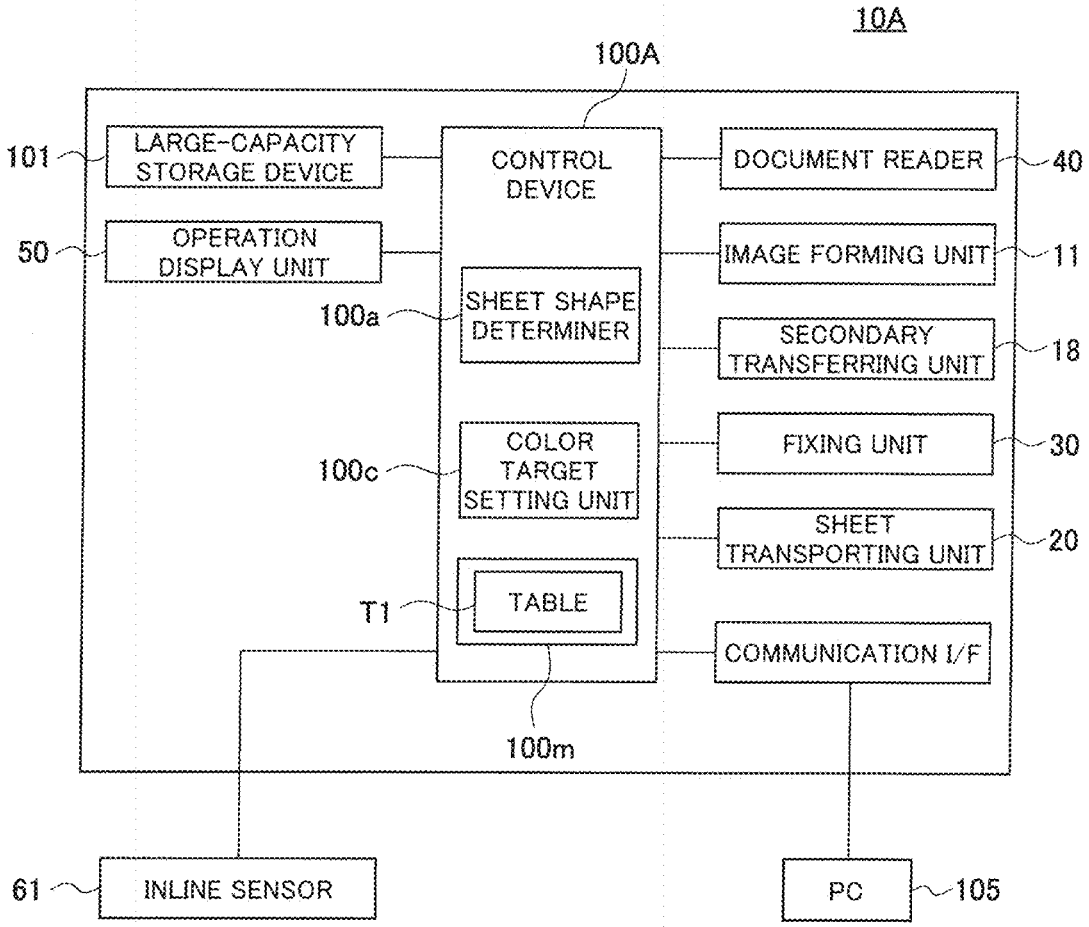
FIG. 31 is a block diagram showing an example of a hardware configuration of an image forming apparatus according to a fifth embodiment of the invention.

FIG. 31 is a block diagram showing a hardware configuration of an image forming apparatus body 10A according to a fifth embodiment of the invention. The image forming apparatus body 10A according to the present embodiment is different from the image forming apparatus body 10 (FIG. 5) according to the first embodiment in that the image forming apparatus body 10A includes a color target setting unit 100*c* of a control device 100A, instead of the correction value calculator 100*b* of the control device 100. The color target setting unit 100*c* sets a color target (target color) from color information of a divided region determined to be a protruding portion on the surface of the sheet.

Figure 32:
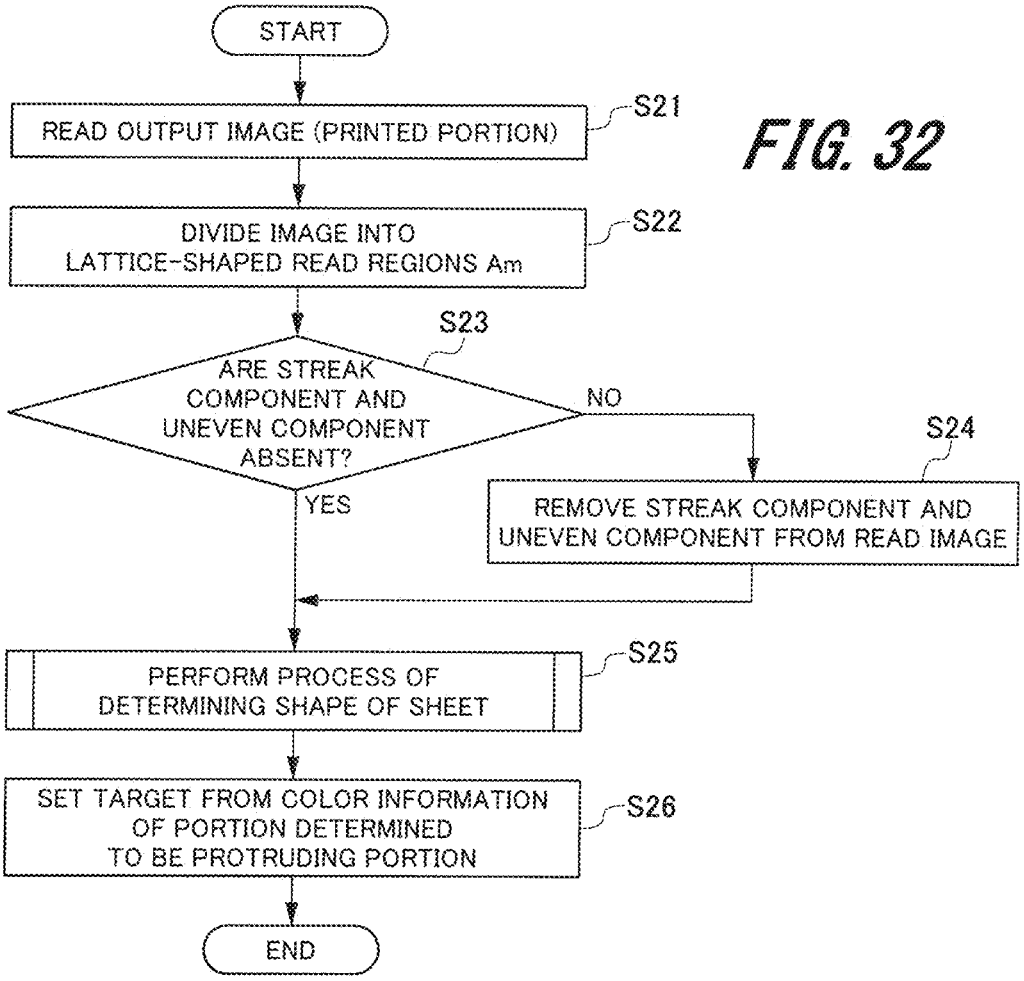
FIG. 32 is a flowchart showing an example of a procedure for a process of setting a target by a control device according to the fifth embodiment of the invention.

FIG. 32 is a flowchart showing an example of a procedure for a process of setting the target by the control device 100A according to the fifth embodiment. Steps S21 to S25 of the flowchart shown in FIG. 32 are the same as steps S1 to S5 of the flowchart shown in FIG. 29, and a description thereof is omitted. After the processes of steps S21 to S25, the color target setting unit 100*c* sets a target from color information of a divided region determined to be a protruding portion on the surface of the sheet (S26).

In the setting of the target, for example, a color conversion table (also referred to as profile) is corrected. In order to perform color conversion, a device profile (DP) of a target device is required. The DP is also referred to as source profile (also referred to as "target profile"). For example, as the source profile, a profile of an offset printer or a standard profile such as Japan Color is selected. The DP of the device for outputting is referred to as destination profile (also referred to as "printer profile"). A profile of the image forming apparatus (for example, the image forming apparatus body 10A) for actually outputting a printed material is selected. Input CMYK values are converted to machine-independent values via an A2B table of the source profile and converted to other (target) CMYK values via a B2A table of the destination profile.

According to the aforementioned fifth embodiment, an effect of the shape of the surface of the sheet can be removed and a target can be set from color information (detected results) on a user real image with high accuracy. Since a special image pattern (detection patch) is not used in the color correction, unnecessary consumption of toner can be suppressed and a reduction in the productivity can be prevented.

6. Sixth Embodiment

Although the aforementioned first to fifth embodiments describe the image forming apparatus system 1 (image forming apparatus bodies 10 and 10A) that includes the intermediate transfer belt as a transfer body and is of the electrophotographic scheme, the configurations of the image forming apparatus bodies are not limited to those described in the embodiments. It is sufficient if each of the image forming apparatuses has a transferring unit for transferring a color toner image onto a sheet. Specifically, each of the image forming apparatuses according to the embodiments of the invention has a transfer body to be rotationally driven, an image forming unit that includes a plurality of developing units that are arranged in series for the basic colors in a rotational driving direction of the transfer body and develop toner images of the basic colors based on input image data, and forms the overlapped color toner images on a surface of the transfer body in a state in which the toner images of the basic colors are aligned, and a transferring unit that transfers the color toner images formed on the transfer body onto the sheet. The toner may be solid toner or liquid toner.

A configuration of an image forming apparatus according to the sixth embodiment is described below.

Figure 33:
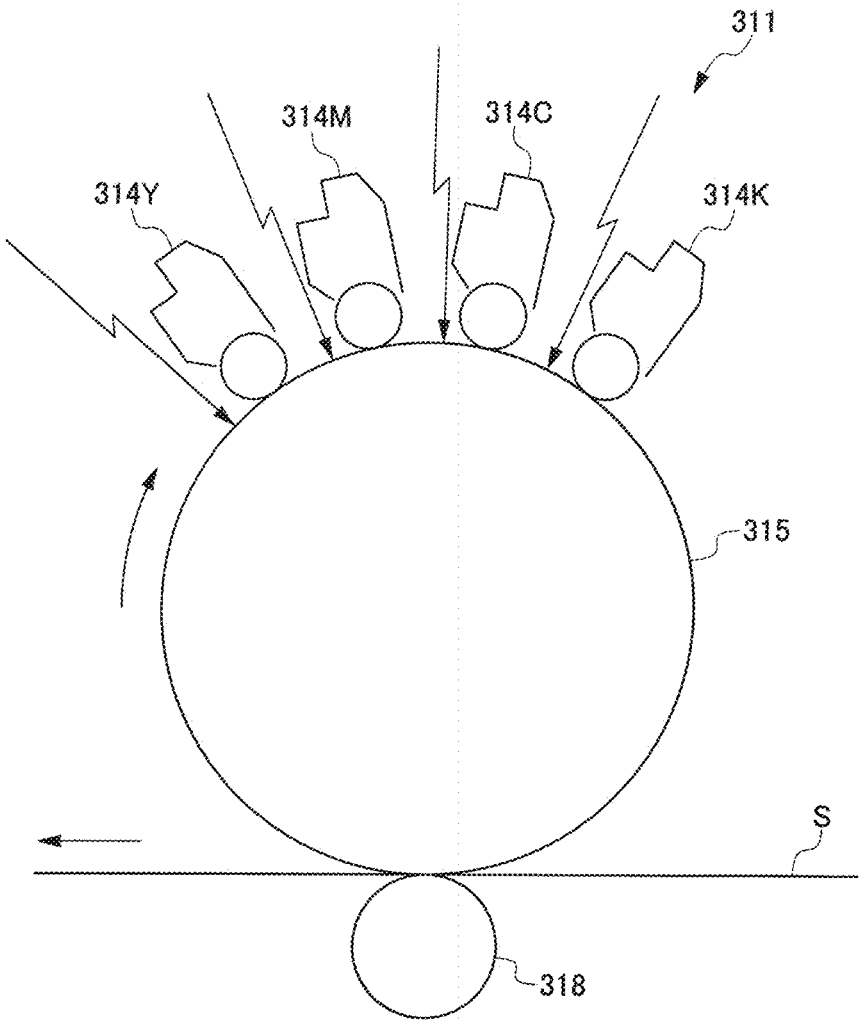
FIG. 33 is a diagram showing an example of a configuration of main components of an image forming apparatus according to a sixth embodiment of the invention.

FIG. 33 is a diagram showing an example of a configuration of main components of the image forming apparatus according to the sixth embodiment. The image forming apparatus shown in FIG. 33 includes an image forming unit 311, a photoreceptor drum 315 (an example of the transfer body), and a transferring unit 318. The image forming unit 311 includes 4 developing units 314Y, 314M, 314C, and 314K for the basic colors (Y, M, C, and K). When the developing units 314Y, 314M, 314C, and 314K are not distinguished from each other, the developing units 314Y, 314M, 314C, and 314K are referred to as "developing units 314" in some cases.

The developing units 314Y, 314M, 314C, and 314K are arranged opposite to a surface (photoreceptor surface) of the photoreceptor drum 315 in this order from the upstream side to downstream side of a rotational driving direction (clockwise direction) of the photoreceptor drum 315. After the same image formation region on the surface of the photoreceptor drum 315 is electrically charged and exposed for each of the basic colors so that an electrostatic latent image is formed for each of the basic colors, the developing units 314 develop the electrostatic latent images of the basic colors to form color toner images. Then, the color toner images formed on the surface of the photoreceptor drum 315 are transferred onto the sheet S by the transferring unit 318.

7. Others

Although each of the first to sixth embodiments describes an example in which the color correction or the target setting is performed based on results of determining recessed and protruding portions on the surface of the sheet, the embodiments are not limited to the examples. For example, results of determining recessed and protruding portions on the surface of the sheet may be used for density correction, the adjustment of the position of an image, and the adjustment of the amount of varnish to be used for coating in special color printing.

Although the first to sixth embodiments describe the image forming apparatuses of the electrophotographic scheme as examples, toner to be used by the image forming apparatuses may be solid toner or liquid toner. In addition, the invention is applicable to an inkjet apparatus using a transfer scheme.

The invention is not limited to the embodiments and includes various application examples and modified examples without departing from the spirit of the invention described in the appended claims.

The embodiments describe the configurations of the apparatuses and the system in detail and specifically in order to clearly explain the invention. The embodiments are not necessarily limited to the configurations including all the aforementioned constituent elements. In addition, a part of a configuration described in an embodiment among the embodiments may be replaced with a constituent element described in another embodiment among the embodiments. A constituent element described in an embodiment among the embodiments may be added to a configuration described in another embodiment among the embodiments. A constituent element described in any of the embodiments may be added to a configuration described in any of the embodiments, or may be removed from a configuration described in the embodiment, or may be replaced with another constituent element described in any of the embodiments.

Some or all of the aforementioned constituent elements, functions, processes, and the like may be enabled by hardware based on, for example, design of an integrated circuit.

DESCRIPTION OF REFERENCE SIGNS

10, 10A . . . Image forming apparatus body, 11 . . . Image forming unit, 18 . . . Secondary transferring unit, 61 . . . Inline sensor (reader), 100, 100A . . . Control device, 100*a*. . . Sheet shape determiner, 100*b*. . . Correction Value Calculator, 100*c*. . . Color target setting unit, T1 . . . Table

What is claimed is:

1. An image forming apparatus comprising:

a transfer body to be rotationally driven;

an image forming unit that includes a plurality of developing units that are arranged in series for basic colors in a rotational driving direction of the transfer body and develop toner images of the basic colors based on input image data, and forms the overlapped color toner images on a surface of the transfer body in a state in which the toner images of the basic colors are aligned;

a transferring unit that transfers the color toner images formed on the transfer body onto a sheet; and a controller that calculates a difference between color information of a read image obtained by allowing a reader to read the color toner images on the sheet and color information of the input image data, calculates a color change direction of the color toner images on the sheet with respect to a color of the input image data based on the difference between the color information, and refers to a table in which color change direction patterns are associated with portions determined to be recessed portions and determines a shape of a surface of the sheet based on information of the color change direction.

2. The image forming apparatus according to claim 1, wherein the controller determines the shape of the surface of the sheet based on whether the color change direction of the color toner images on the sheet with respect to the color of the input image data is a color change direction toward a printing upstream side that is the side of a basic color of a developing unit arranged on an upstream side in the rotational driving direction of the transfer body or is a color change direction toward a printing downstream side that is the side of a basic color of a developing unit arranged on a downstream side in the rotational driving direction of the transfer body.

3. The image forming apparatus according to claim 1, wherein the controller divides the read image obtained by reading the color toner images on the sheet into a plurality of regions and determines, based on a result of determining a divided region existing around a target divided region, the shape of the target divided region.

4. The image forming apparatus according to claim 3, wherein the controller determines the shape of the target divided region based on the periodicity of the shape of the surface of the sheet.

5. The image forming apparatus according to claim 3, wherein the controller determines the shape of the target divided region based on the number of divided regions existing around the target divided region and determined to be recessed portions and the number of divided regions existing around the target divided region and determined to be protruding portions.

6. The image forming apparatus according to claim 1, wherein the controller excludes, from information to be used for the determination, information that is included in the color information of the read image obtained by reading the color toner images and corresponds to a streak component and an uneven component.

7. The image forming apparatus according to claim 6, wherein the controller excludes, from the information to be used for the determination, information that is included in the color information of the read image obtained by reading the color toner images and indicates a periodic color change component corresponding to a component included in the apparatus and having periodicity.

8. The image forming apparatus according to claim 1, wherein the controller excludes, from information to be used for the determination, information that is included in the color information of the read image obtained by reading the color toner images and indicates that a density is low in a region extending to an end of the sheet in a direction perpendicular to a conveying direction of the sheet.

9. The image forming apparatus according to claim 1, wherein the controller calculates a correction value to be used to correct a color change caused by the image forming unit from color information of a divided region determined to be a protruding portion as the shape of the surface of the sheet.

10. The image forming apparatus according to claim 1, wherein the controller sets a target from color information of a divided region determined to be a protruding portion as the shape of the surface of the sheet.

11. The image forming apparatus according to claim 1, further comprising, as the transfer body:

a plurality of photoreceptor drums that are arranged corresponding to the plurality of developing units and develop the toner images of the basic colors corresponding to the developing units;

and an intermediate transfer body having a surface onto which the overlapped color toner images are transferred in a state in which the toner images, developed on the plurality of photoreceptor drums, of the basic colors are aligned, wherein the transferring unit transfers the color toner images transferred to the intermediate transfer body onto the sheet.

12. A computer-readable recording medium storing a program for causing a computer, which is included in an image forming apparatus including a transfer body to be rotationally driven, an image forming unit that includes a plurality of developing units that are arranged in series for basic colors in a rotational driving direction of the transfer body and develop toner images of the basic colors based on input image data, and forms the overlapped color toner images on a surface of the transfer body in a state in which the toner images of the basic colors are aligned, to perform:

calculating a difference between color information of a read image obtained by allowing a reader to read the color toner images on the sheet and color information of the input image data;

calculating, based on the difference between the color information, a color change direction of the color toner images on the sheet with respect to a color of the input image data; and referring to a table in which color change direction patterns are associated with portions determined to be recessed portions and determining a shape of a surface of the sheet.

* * * * *